US010191410B2

(12) United States Patent
Kawasaki et al.

(10) Patent No.: US 10,191,410 B2
(45) Date of Patent: Jan. 29, 2019

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Shuhei Kawasaki, Susono (JP); Hisashi Taniguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 15/335,591

(22) Filed: Oct. 27, 2016

(65) Prior Publication Data

US 2017/0123345 A1 May 4, 2017

(30) Foreign Application Priority Data

Oct. 30, 2015 (JP) ..... 2015-214954
Oct. 30, 2015 (JP) ..... 2015-214982

(51) Int. Cl.
*G03G 15/08* (2006.01)

(52) U.S. Cl.
CPC ..... *G03G 15/0865* (2013.01); *G03G 15/0808* (2013.01); *G03G 15/0889* (2013.01)

(58) Field of Classification Search
CPC ..... G03G 15/0865
See application file for complete search history.

(56) References Cited

U.S. PATENT DOCUMENTS 4,930,438 A * 6/1990 Demizu ..... G03G 15/0808 399/281
5,790,153 A * 8/1998 Takagi ..... B41J 2/4155 347/112
5,809,386 A * 9/1998 Iwata ..... G03G 15/0808 399/102
7,280,788 B2 * 10/2007 Iwakura ..... G03G 15/065 399/296
7,860,437 B2 12/2010 Kakuta et al.
8,185,023 B2 5/2012 Kakuta et al.
(Continued)

FOREIGN PATENT DOCUMENTS

JP 2008-170951 A 7/2008
JP 2015-092279 A 5/2015

*Primary Examiner* — Benjamin Schmitt
*Assistant Examiner* — Milton Gonzalez
(74) *Attorney, Agent, or Firm* — Venable LLP

(57) ABSTRACT

A developing device for use with an image forming apparatus includes a developer carrying member carrying a developer for developing a latent image, a supplying member for supplying the developer to the developer carrying member and forming a nip in contact with the developer carrying member, and an accommodating portion, provided below the supplying member in a state the developing device is mounted on the image forming apparatus for use, for accommodating the developer to be supplied from the supplying member to the developer carrying member. In addition, a feeding member, provided in the accommodating portion, feeds the developer accommodated in the accommodating portion to the supplying member, and a rotatable member, provided above the feeding member and located at a downstream side of the nip with respect to a rotational direction of the supplying member, moves the developer toward the nip.

11 Claims, 11 Drawing Sheets

(56) References Cited

U.S. PATENT DOCUMENTS

| | | | | |
|---|---|---|---|---|
| 8,489,003 | B2 * | 7/2013 | Ebe | G03G 15/0812 399/281 |
| 8,532,544 | B2 | 9/2013 | Kakuta et al. | |
| 8,600,249 | B2 | 12/2013 | Kawaguchi et al. | |
| 9,116,459 | B2 | 8/2015 | Yamamoto et al. | |
| 2013/0108329 | A1 * | 5/2013 | Yoshida | G03G 15/0189 399/281 |
| 2013/0287452 | A1 * | 10/2013 | Yoshida | G03G 15/0806 399/281 |

* cited by examiner

DEVELOPING DEVICE, PROCESS CARTRIDGE, AND IMAGE FORMING APPARATUS

FIELD OF THE INVENTION AND RELATED ART

The present invention relates to a developing device for use with an image forming apparatus, a process cartridge, and the image forming apparatus including the developing device or the developing chamber, and is suitably applicable to an electrophotographic image forming apparatus or the like.

The electrophotographic image forming apparatus forms an image on a recording material (medium) by using an electrophotographic image forming process. Examples of the image forming apparatus may include a copying machine, a printer (laser beam printer, LED printer or the like), a facsimile machine, a word processor and a multi-function machine (multi-function printer or the like) of these machines.

The developing device is a device for developing (visualizing) an electrostatic latent image (electrostatic image) on an image bearing member such as a photosensitive member (electrophotographic) photosensitive member, with a developer. The developing device may also be detachably mountable to an apparatus main assembly of an image forming apparatus. In this case, the apparatus main assembly of the image forming apparatus is a portion of the image forming apparatus excluding the developing device.

The process cartridge is prepared in general by integrally assembling a photosensitive member and, as process means, at least one of a charging means, a developing means and a cleaning means into a cartridge (unit), and is made detachably mountable to the apparatus main assembly of the image forming apparatus. In the present invention, the process cartridge includes, as the process means, at least the developing device which is the developing means. In this case, the apparatus main assembly of the image forming apparatus is a portion of the image forming apparatus excluding the process cartridge.

In the image forming apparatus such as a printer using the electrophotographic image forming process (electrophotographic process), image recording (formation) is effected in the following manner. The photosensitive member (electrophotographic photosensitive member) as the image bearing member is electrically charged uniformly, and the charged photosensitive member is selectively exposed to light, so that the electrostatic latent image is formed on the photosensitive member. The electrostatic latent image formed on the photosensitive member is developed (visualized) into a toner image with toner as the developer. Then, the toner image formed on the photosensitive member is transferred onto the recording material such as a recording sheet, a plastic sheet or the like. The toner image transferred on the recording material is fixed on the recording material under application of heat and pressure.

Such an image forming apparatus is generally required to be supplied with the developer to perform maintenance of respective process means. In order to facilitate these, there is a process cartridge type in which the photosensitive member, the charging means, the developing means, the cleaning means and the like are integrally assembled into a cartridge in a frame and in which the resultant process cartridge is made detachably mountable to the apparatus main assembly.

As an image forming apparatus for forming color images by using developers of a plurality of colors, there is an image forming apparatus of an in-line type in which a plurality of photosensitive members on which toner images are formed with the developers of the respective colors are arranged in line along a movement direction of a toner image receiving member onto which the toner images are to be transferred. The image forming apparatus of the in-line type includes one in which a plurality of photosensitive members are arranged in line along a direction (e.g., the horizontal direction) crossing a direction of gravitation (vertical direction) in some cases. Of these image forming apparatuses, there are image forming apparatuses in which the plurality of photosensitive members are disposed below an intermediary transfer member as the toner image receiving member or below a recording material carrying member for feeding the recording material as the toner image receiving member (Japanese Laid-Open Patent Application (JP-A) 2015-92279 and JP-A 2008-170951). By disposing the image forming apparatuses as described above, in the apparatus main assembly, a fixing device and the developing device (or the exposure device) can be disposed at spaced positions from each other with respect to the intermediary transfer member or the recording material carrying member. As a result, the image forming apparatuses have such an advantage that the developing device (or the exposure device) is not readily influenced by heat of the fixing device.

On the other hand, in the case where the photosensitive members are disposed below the intermediary transfer member or the recording material carrying member, there is a need to supply the developer to a developer carrying member (drive or the like) or a supplying member (supplying roller or the like) against gravitation in the developing device in some cases. The developer carrying member feeds the developer to an opposing portion between itself and the photosensitive member while carrying the developer. Further, the supplying member supplies the developer, fed from an accommodating portion (accommodating chamber) for accommodating the developer, to the developer carrying member.

In a constitution in which the developer is supplied to the developer carrying member or the supplying member against the gravitation, scooping-up of the toner from the accommodating portion to the neighborhood of the developer carrying member or the supplying member is intermittently performed, and therefore, supply of the toner the surface or the inside of the supplying member is important for the purpose of stabilizing an image density.

However, in the conventional constitution, it turned out that a lowering in solid image density (improper solid image following property) due to improper toner supply from the supplying member to the developer carrying member is generated in some cases.

SUMMARY OF THE INVENTION

A principal object of the present invention is to provide a developing device, a process cartridge, and an image forming apparatus which are capable of stably supplying a developer from a sheet to a developer carrying member in a constitution in which a developer accommodating portion is provide below the supplying member.

According to an aspect of the present invention, there is provided a developing device for use with an image forming apparatus, comprising: a developer carrying member, rotatable while carrying a developer, for developing a latent image with the developer; a supplying member, forming a nip in contact with the developer carrying member, for supplying the developer to the developer carrying member by being rotated; an accommodating portion, provided below the supplying member, for accommodating the developer; a feeding member, provided in the accommodating portion, for feeding the developer accommodated in the accommodating portion to the supplying member; and a rotatable member, provided downstream of the nip with respect to a rotational direction of the supplying member, for moving the developer toward the nip.

According to another aspect of the present invention, there is provided a process cartridge detachably mountable to a main assembly of an image forming apparatus, comprising an image bearing member on which a latent image is to be formed, and the above-described developing device.

According to a further aspect of the present invention, there is provided an image forming apparatus for forming an image on a recording material, comprising an image bearing member on which a latent image is to be formed, and the above-described developing device.

Further features of the present invention will become apparent from the following description of exemplary embodiments with reference to the attached drawings.

DESCRIPTION OF THE EMBODIMENTS

Hereinbelow, a developing device, a process cartridge and an image forming apparatus according to the present invention will be specifically described with reference to the drawings.

First Embodiment (Embodiment 1)

1. General Structure of Image Forming Apparatus

Figure 1:
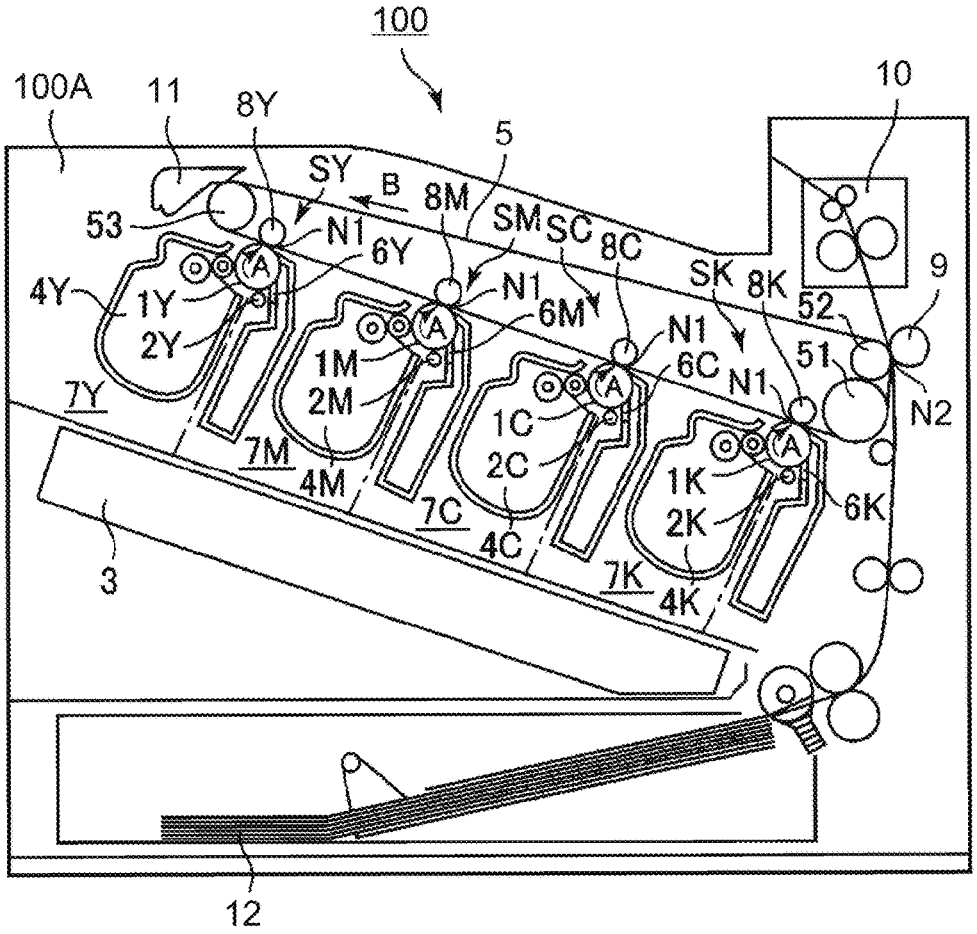
FIG. 1 is a schematic sectional view of an image forming apparatus in a First Embodiment (Embodiment 1) of the present invention.

First, a general structure of the image forming apparatus in this embodiment will be described. FIG. 1 is a schematic sectional view of an image forming apparatus 100 in this embodiment. The image forming apparatus 100 in this embodiment is a full-color laser beam printer employing an in-line type and an intermediary transfer type, and is capable of forming a full-color image, in accordance with image information, on a recording material such as a recording sheet, a plastic sheet or cloth. The image information is inputted into an apparatus main assembly 100A from a host device such as an image reader connected with the apparatus main assembly 100A of the image forming apparatus or a personal computer communicatably connected with the apparatus main assembly 100A.

The image forming apparatus 100 includes, as a plurality of image forming portions, first to fourth image forming portions SY, SM, SC and SK for forming images of colors of yellow (Y), magenta (M), cyan (C) and black (K), respectively. In this embodiment, the image forming portions SY, SM, SC and SK are arranged in line in a direction crossing a direction of gravitation.

In this embodiment, constitutions and operations of the first to fourth image forming portions SY, SM, SC and SK are the substantially same except that the colors of the images to be formed are different from each other. Accordingly, in the following description, in the case where the image forming portions are not particularly required to be distinguished from each other, suffixes Y, M, C and K added to reference numerals for representing elements for the associated colors are omitted, and the elements for the associated colors will be collectively described.

In this embodiment, the image forming apparatus 100 includes, as a plurality of image bearing members, four drum-type photosensitive members (electrophotographic photosensitive members) which are juxtaposed in a direction crossing the direction of gravitation, i.e., photosensitive drums 1. Each of the photosensitive drums 1 is rotationally driven in an indicated arrow A direction (clockwise direction) by an unshown driving motor as a driving means (driving source). At a periphery of the photosensitive drum 1, a charging roller 2 as a charging means, for electrically charging the surface of the photosensitive drum 1 uniformly, a scanner unit (exposure means) for forming an electrostatic latent image on the photosensitive drum 1 by irradiating the photosensitive drum 1 with laser light on the basis of image information are provided. In this embodiment, the scanner unit 3 is constituted as a single unit capable of emitting the laser light on the basis of the image information corresponding to the associated color of the photosensitive drum 1. Further, at the periphery of the photosensitive drum 1, a developing unit (developing device) 4 as a developing means for developing the electrostatic latent image into a toner image and a cleaning member 6 as a cleaning means for removing toner (transfer residual toner) remaining on the surface of the photosensitive drum 1 after transfer are provided. Further, an intermediary transfer belt 5 as an intermediary transfer member for transferring the toner image from the photosensitive drum 1 onto a recording material 12.

In this embodiment, the developing unit 4 effects reversal development by contacting a developing roller (described later) as a developer carrying member to the photosensitive drum 1. That is, in this embodiment, the developing unit 4 develops the electrostatic latent image by depositing the toner charged to the same polarity (negative in this embodiment) as a charge polarity of the photosensitive drum 1 on a portion (image portion, exposed portion) where electric charges are attenuated by the exposure of the photosensitive drum 1 to light.

In this embodiment, the photosensitive drum 1 and, as process means actable on the photosensitive drum 1, the charging roller 2, the developing unit 4 and the cleaning member 6 are integrally assembled into a cartridge (unit) to form a process cartridge 7. The process cartridge 7 is detachably mountable to the apparatus main assembly 100A of the image forming apparatus 100 via mounting means such as a mounting guide, a positioning member and the like which are provided in the apparatus main assembly 100A of the image forming apparatus 100. In this embodiment, all of the process cartridges 7 for the respective colors have the same shape, and color toners of yellow (Y), magenta (M), cyan (C) and black (K) are accommodated in the process cartridges 7.

The intermediary transfer belt 5 formed with an endless belt as the intermediary transfer member contacts all the photosensitive drums 1, and circulates and moves (rotates) in an arrow B direction (counterclockwise direction) indicated in FIG. 1. The intermediary transfer belt 5 is extended around, as a plurality of supporting members, a driving roller 51, a secondary transfer opposite roller 52, and a follower roller 53. In an inner peripheral surface (back surface) side of the intermediary transfer belt 5, as primary transfer means, four primary transfer rollers 8 are juxtaposed so as to oppose the associated photosensitive drums 1. The primary transfer roller 8 urges the intermediary transfer belt 5 toward the photosensitive drum 1 and forms a primary transfer portion N1 where the intermediary transfer belt 5 and the photosensitive drum 1 contact each other. Further, to the primary transfer roller 8, from an unshown primary transfer bias voltage source (high voltage source circuit) as a primary transfer bias applying means, a DC bias (DC voltage) of an opposite polarity to the charge polarity (normal charge polarity) of the toner during the development is applied. As a result, the toner image is transferred (primary-transferred) onto the intermediary transfer belt 5. Further, in an outer peripheral surface (front surface) side, at a position opposing the secondary transfer opposite roller 52, a secondary transfer roller 9 as a secondary transfer means is provided. The secondary transfer roller 9 press-contacts the intermediary transfer belt 5 to the secondary transfer opposite roller 52, and forms a secondary transfer portion N2 where the intermediary transfer belt 5 and the secondary transfer portion N2 contact each other. Further, to the secondary transfer roller 9, from an unshown secondary transfer bias voltage source (high voltage source circuit) as a secondary transfer bias applying means, a DC bias (DC voltage) of the opposite polarity to the normal charge polarity of the toner is applied. As a result, the toner image is transferred (secondary-transferred) from the intermediary transfer belt 5 onto the recording material 12.

Further, during the image formation, first, the surface of the photosensitive drum 1 is electrically charged uniformly by the charging roller 2. The charged surface of the photosensitive drum 1 is subjected to scanning exposure to laser light which is outputted from the scanner unit 3 depending on image information, so that, on the photosensitive drum 1, the electrostatic latent image depending on the image information is formed.

Then, the electrostatic latent image formed on the photosensitive drum 1 is developed into the toner image (developer image) by the developing device 4. The toner image formed on the photosensitive drum 1 is transferred (primary-transferred) onto the intermediary transfer belt 5 by the action of the primary transfer roller 8.

For example, during full-color image formation, the above-described process is successively performed at the first to fourth image forming portions SY, SM, SC and SK, and then the toner images of the respective colors are successively transferred superposedly onto the intermediary transfer belt 5.

On the other hand, in synchronism with the toner image movement onto the intermediary transfer belt 5, the recording material 12 is fed to the secondary transfer portion N2. By the action of the secondary transfer roller 9 contacting the recording material 12 toward the intermediary transfer belt 5, the toner images are transferred (secondary-transferred) from the intermediary transfer belt 5 onto the recording material 12.

The recording material 12 on which the toner images are transferred is fed to a fixing device 10 as a fixing means. The fixing device 10 applies heat and pressure to the recording material 12, so that the toner image is fixed on the recording material 12.

Toner (primary transfer residual toner) remaining on the photosensitive drum 1 after a primary transfer step is removed from the photosensitive drum 1 by the cleaning member 6 and then is collected. On the other hand, toner (secondary transfer residual toner) remaining on the intermediary transfer belt 5 after a secondary-transfer step is removed from the intermediary transfer belt 5 by an intermediary transfer belt cleaning device 11 and then is collected.

In this embodiment, the process cartridges 7 for the respective colors, the scanner units 3 for effecting exposure for the respective colors, the primary transfer rollers 8 for the respective colors and the like constitute the image forming portions S for the respective colors.

The image forming apparatus 100 can also form a monochromatic (single-color) image or a multi-color image by using only a desired one image forming portion or only several (but not all of) desired image forming portions.

2. General Structure of Process Cartridge

Next, a general structure of the process cartridge 7 to be mounted in the image forming apparatus 100 in this embodiment will be described.

In this embodiment, structures and operations of the process cartridges 7 for the respective colors are the substantially same except for kind (colors) of the toners accommodated.

Figure 2:
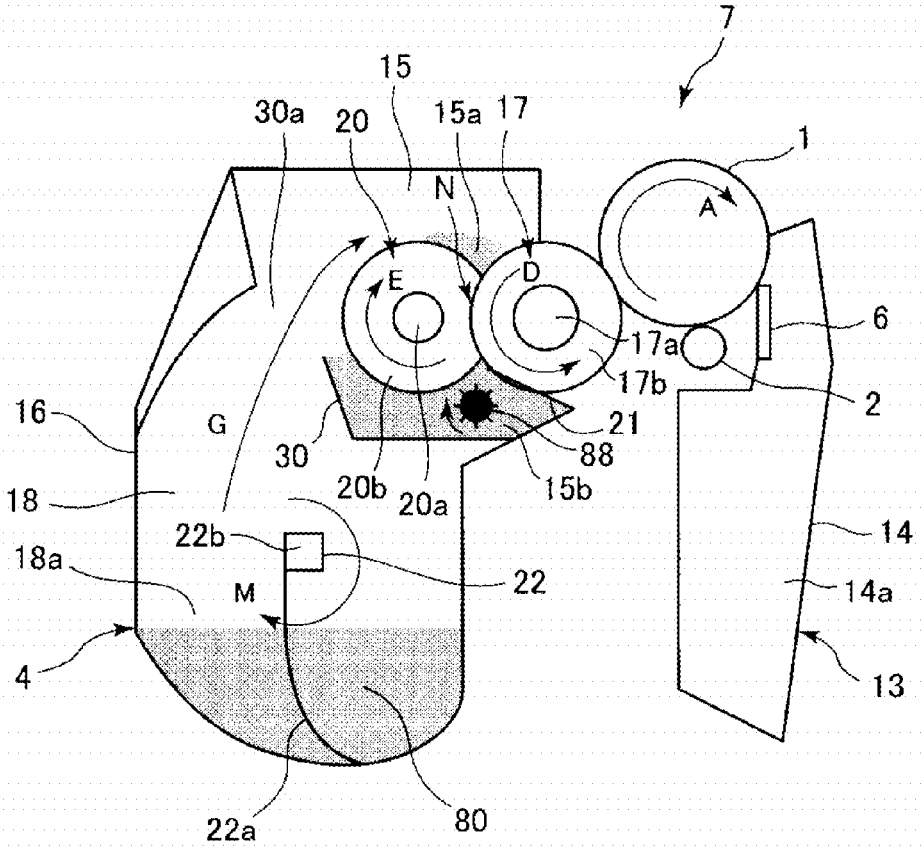
FIG. 2 is a schematic sectional view of a process cartridge in the First Embodiment (Embodiment 1) of the present invention.

FIG. 2 is a schematic sectional view (principal sectional view) of the process cartridge 7 in this embodiment as seen along a longitudinal direction (rotational axis direction). In FIG. 2, the process cartridge 7 is shown by an attitude thereof in a state in which the process cartridge 7 is mounted and used in the apparatus main assembly 100A. In the following, in the case where positional relationships and directions of respective members of the process cartridge 7 are described, the positional relationships and the directions are those in this attitude of the process cartridge 7. Incidentally, above and below refer to those with respect to the direction of gravitation (vertical direction), but do not mean only just above and just below, but also include an upper side and a lower side with respect to the horizontal direction passing through an associated reference element or position.

The process cartridge 7 has a structure in which a photosensitive member unit 13 including the photosensitive drum 1 and the like and the developing unit 4 including a developing roller 17 and the like are integrally assembled.

The photosensitive member unit 13 includes a cleaning frame 14 as a frame for supporting various elements (components) in the photosensitive member unit 13. To the cleaning frame 14, the photosensitive drum 1 is rotatably secured via an unshown bearing. The photosensitive drum 1 is rotationally driven in the indicated arrow A direction (clockwise direction) depending on an image forming operation by transmitting a driving force from a driving motor provided in the apparatus main assembly 100A to the photosensitive member unit 13. In this embodiment, as a principal element of the image forming process, the photosensitive drum 1 is an organic photosensitive drum obtained by successively coating an outer peripheral surface of an aluminum cylinder with an under coat layer, a carrier generating layer and a carrier transporting layer which are functional films. In the photosensitive member unit 13, the charging roller 2 and the cleaning member 6 are provided in contact with the outer peripheral surface of the photosensitive drum 1. A transfer residual toner removed from the surface of the photosensitive drum 1 by the cleaning member 6 drops in a residual toner chamber 14*a* formed by the cleaning frame 14 and is accommodated in the residual toner chamber 14*a*. The charging roller 2 is disposed in pressure-contact with the photosensitive drum 1 at its roller portion of an electroconductive rubber and is rotated with rotation of the photosensitive drum 1.

During a charging step, to a core metal of the charging roller 2, a predetermined DC voltage is applied, so that a uniform dark-portion potential (Vd) is formed on the surface of the photosensitive drum 1. The photosensitive drum 1 is exposed to a spot pattern of the laser light emitted from the scanner unit 3 corresponding to the scanner unit 3. At an exposed portion of the photosensitive drum 1, surface electric charges disappear by carriers from the carrier generating layer, so that an absolute value of the potential lowers. As a result, the exposed portion has a predetermined light-portion potential (Vl) and an unexposed portion has the predetermined dark-portion potential (Vd), so that the electrostatic latent image is formed on the photosensitive drum 1. In this embodiment, Vd=−500 V and Vl=−100 were set.

The developing unit 4 includes a developing frame 16 as a frame for supporting respective elements in the developing unit 4. In this embodiment, an inside of the developing frame 16 is partitioned into a developing chamber 15 and an accommodating chamber 18 by a partitioning member (partition wall) 30 constituted by a part of the developing frame 16. In the developing chamber 15, the developing roller 17 as the developer carrying member for feeding toner 80 to an opposing portion to the photosensitive drum 1 while carrying the toner 80 and a supplying roller 20 as a supplying member for supplying the toner 80 to the developing roller 17 are provided. In the developing chamber 15, a developing blade 21 as a regulating member and an auxiliary retaining member 88 specifically described later are provided. In the accommodating chamber 18, an accommodating portion 18*a* for accommodating the toner 80 to be fed to the developing chamber 15 is formed below the developing chamber 15, i.e., below the supplying roller 20. The partitioning member 30 is provided with an opening 30*a* which establishes communication between the developing chamber 15 and the accommodating chamber 18 and which permits passing of the toner fed from the accommodating chamber 18 to the developing chamber 15 and the toner returned from the developing chamber 15 through the opening 30*a*. In the accommodating chamber 18, a feeding member (stirring feeding member) 22 is provided.

The supplying roller 20 contacts the developing roller 17 and forms a nip N (portion where the toner is nipped between the developing roller 17 and the supplying roller 20) between itself and the developing roller 17. In this embodiment, the supplying roller 20 and the developing roller 17 are rotationally driven so as to move from above toward below in the same directions at surfaces thereof in the nip N. That is, the supplying roller 20 is rotationally driven in an arrow E direction (clockwise direction), and the developing roller 17 is rotationally driven in an arrow D direction (counterclockwise direction) as shown in FIG. 2.

Figure 3:
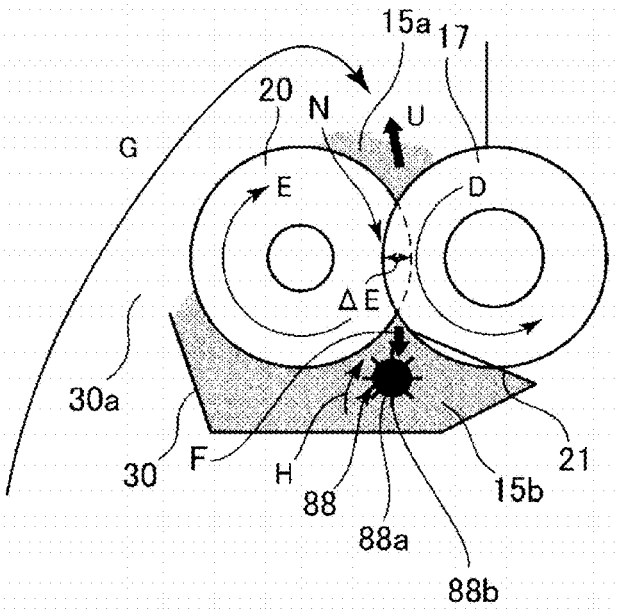
FIG. 3 is an enlarged sectional view of a developing device in the First Embodiment (Embodiment 1).

The developing roller 17 is an electroconductive rubber roller which is prepared by forming an electroconductive rubber layer 17*b* as an elastic layer on an outer peripheral surface of an electroconductive core metal 17*a* and which is 18 mm in outer diameter. Further, the supplying roller 20 is an elastic sponge roller which is prepared by forming a foam member layer 20*b* as an elastic layer on an outer peripheral surface of an electroconductive core metal 20*a* and which is 18 mm in outer diameter. That is, the supplying roller 20 includes a foam image (porous member) at its surface. The supplying roller 20 and the developing roller 17 contacts with a predetermined penetration amount. That is, in this embodiment, as shown in FIG. 3, the supplying roller 20 is deformed in a recessed shape by the developing roller 17. A recessed amount ΔE is the penetration amount.

The supplying roller 20 and the developing roller 17 rotate in the same direction at the nip N with a peripheral speed difference, and by this operation, toner supply to the developing roller 17 by the supplying roller 20 is made. At that time, by adjusting a potential difference between the supplying roller 20 and the developing roller 17, an amount of the toner supplied to the developing roller 17 can be adjusted. In this embodiment, a rotational speed (the number of rotations (turns) per unit time) of the supplying roller 20 is higher than a rotational speed of the developing roller 17. As an example, the rotational speed of the supplying roller 20 can be set at 200 rpm (the number of rotations per minute), and the rotational speed of the developing roller 17 can be set at 100 rpm. Further, in this embodiment, a DC bias (DC voltage) is applied from an unshown supplying bias voltage source (high voltage source circuit) as a supplying bias applying means to the supplying roller 20 so as to have the same potential as the developing roller 17.

In this embodiment, the developing roller 17 and the supplying roller 20 both have the outer diameter of 18 mm, and the penetration amount (recessed amount) ΔE of the supplying roller 20 into the developing roller 17 was set at 1.0 mm. Further, the supplying roller 20 and the developing roller 17 are disposed so that height of rotation centers thereof are the same.

In the accommodating chamber 18, the feeding member 22 is provided. The feeding member 22 not only stirs the toner accommodated in the accommodating chamber 18 by rotation thereof but also feeds the toner toward above the supplying roller 20 along an arrow G direction shown in FIG. 3. In this embodiment, the rotational speed of the feeding member 22 is lower than the rotational speed of the developing roller 17. As an example, the rotational speed of the feeding member 22 can be set at 30 rpm.

The feeding member 22 includes a flexible sheet portion 22*a* as a feeding portion for feeding the toner and a feeding supporting shaft (rotation shaft) 22*b* for not only permitting mounting of the sheet portion 22*a* thereon but also receiving a rotational driving force. The feeding supporting shaft 22*b* is disposed over an entire region of the accommodating chamber 18 with respect to the longitudinal direction substantially in parallel with rotational axis directions of the photosensitive drum 1, the developing roller 17 and the supplying roller 20. The sheet portion 22*a* is a continuous sheet (photo-shaped member) extending over an entire region of the feeding supporting shaft 22*b* with respect to the rotational axis direction. The sheet portion 22*a* is mounted to the feeding supporting shaft 22*a* at one end portion thereof with respect to a direction (rotation radius direction) substantially perpendicular to the rotational axis direction of the feeding supporting shaft 22*b*. The sheet portion 22*a* is rotatably supported by the developing frame 16 forming the accommodating chamber 18, at end portions thereof with respect to the rotational axis direction thereof, and is rotationally driven in an indicated arrow M direction (clockwise direction) by a driving motor provided in the apparatus main assembly 100A. In this embodiment, a material of the sheet portion 22*a* is a polycarbonate (PC) film, and a thickness of the sheet portion 22*a* is 300 μm. The material and the thickness of the sheet portion 22*a* are not limited to thereto. For example, other materials, such as a polyester film, a polyphenylenesulfide film, another polycarbonate film, having a proper thickness are usable when the materials are elastically deformable.

The developing blade 21 is disposed under the developing roller 17 and is contacted counterdirectionally (with respect to a direction in which a free and faces an upstream side with respect to the rotational direction of the developing roller 17) to the developing roller 17. The developing blade 21 regulates a coating amount (layer thickness) of the toner supplied to the developing roller 17 by the supplying roller 20 and imparts electric charges to the toner. In this embodiment, as the developing blade 21, a 0.1 mm-thick leaf spring-shaped thin plate of SUS was used. The developing blade 21 forms contact pressure by using spring elasticity of the thin plate, and surface-contacts the toner and the developing roller 17. A material of the developing blade 21 is not limited to the above material, but may also be a thin plate of metal such as phosphor bronze or aluminum, for example. Further, as the developing blade 21, those surface-coated with a thin film of polyamide elastomer, urethane rubber, urethane resin or the like may also be used.

The toner is triboelectrically charged by sliding between the developing blade 21 and the developing roller 17, so that electric charges are imparted to the toner and a layer thickness of the toner is regulated. Further, in this embodiment, to the developing blade 21, a predetermined DC bias (DC voltage) is applied from an unshown blade bias voltage source (high voltage source circuit) as a blade bias applying means. As a result, coating of the toner on the developing roller 17 is stabilized. In this embodiment, a blade bias V=−500 V was applied to the developing blade 21.

The developing roller 17 and the photosensitive drum 1 are rotationally driven so that surfaces thereof move in the same direction (from below toward above in this embodiment) at their opposing portion (contact portion). In this embodiment, the developing roller 17 is disposed in contact with the photosensitive drum 1, but may also be disposed close to the photosensitive drum 1 with a predetermined gap from the photosensitive drum 1. In this embodiment, to the developing roller 17, a DC bias (DC voltage) is applied from an unshown developing bias voltage source (high voltage source circuit) as a developing bias applying means. As a result, the toner triboelectrically charged to the negative polarity is transferred not only to the light-potion potential portion at a developing portion where the developing roller 17 contacts the photosensitive drum 1, by a potential difference between the potential of the developing roller 17 and the light-portion potential of the photosensitive drum 1. In this embodiment, by applying a voltage V=−300 V to the developing roller 17, a potential difference ΔV=200 V is formed between the developing roller potential and the light-portion potential of the photosensitive drum 1, so that the toner is deposited on the light-portion potential portion and thus the toner image was formed.

The foam member layer 20*b* of the supplying roller 20 will be further described. In this embodiment, an outer diameter of the electroconductive supporting member 20*a* is 5 mm. In this embodiment, the foam member layer 20*b* formed around the electroconductive supporting member 20*a* is constituted by a foam urethane layer of an open-cell type in which air bubbles connect with each other. A surface layer of urethane has the open-cell structure, so that the toner can enter the supplying roller 20 in a large amount. In this embodiment, an electrical resistance of the supplying roller 20 is $1\times10^{9}\Omega$. A measuring method of the electrical resistance of the supplying roller 20 is as follows. The supplying roller 20 is contacted to an aluminum sleeve of 30 mm in diameter so as to have a penetration amount of 1.5 mm. By rotating the aluminum sleeve, the supplying roller 20 is rotated at 30 rpm by rotation of the aluminum sleeve. Then, a DC voltage of −50 V is applied to the aluminum sleeve. At that time, a resistor element of 10 kΩ is provided in the ground side and a voltage at both ends is measured, so that a current is calculated and then the electrical resistance of the supplying roller 20 is calculated.

A surface cell diameter of the supplying roller 20 may preferably be about 50 μm to about 1000 μm. Here, the cell diameter refers to an average diameter of foam cell in an arbitrary cross-section. First, from an enlarged image of the arbitrary cross-section, an area of a maximum foam cell is measured and is converted into a true-circle corresponding diameter, so that a maximum cell diameter is acquired. Then, foam cells having diameters which are not more than ½ of the maximum cell diameter are deleted as noise, and thereafter an average of cell diameters similarly converted from remaining cell areas is acquired and is used as the cell diameter.

3. Flow of Toner

A flow of the toner in the developing chamber 15 will be described with reference to FIGS. 2 and 3. FIG. 3 is an enlarged schematic sectional view showing an inside of the developing chamber 15, and shows motion of the toner 80 fed from the accommodating chamber 18 toward the supplying roller 20 by the feeding member 22.

The toner accommodated in the accommodating chamber 18 is flipped up by the feeding member 22 along a flying locus shown by an arrow G. Most of the toner is supplied to a first retaining portion 15*a* which is a region (space) on the supplying roller 20 and on the developing roller 17 and the supplying roller 20 (i.e., above the nip N) in the developing chamber 15. The toner supplied to the first retaining portion 15*a* is fed to a position immediately in front of the nip N between the developing roller 17 and the supplying roller 20 by rotation of the supplying roller 20 in an indicated arrow E direction. The supplying roller 20 is compressedly deformed at the position immediately in front of the nip N between, so that the toner remaining at the surface and the inside of the supplying roller 20 is discharged in an indicated above U direction by the deformation. The discharged toner is accommodated (retained) in the first retaining portion 15*a* which is the region (space) on the developing roller 17 and the supplying roller 20 in the developing chamber 15 (i.e., above the nip N). A part of the toner accumulated in the first retaining portion 15*a* enters the nip N by rotation of the developing roller 17 and the supplying roller 20. The toner entering the nip N is supplied with electric charges by sliding between the developing roller 17 and the supplying roller 20. The toner having the electric charges passes through the nip N, and thereafter is electrostatically attracted to the developing roller 17 by the electric charges. Thus, the toner is supplied from the supplying roller 20 to the developing roller 17. Then, a part of the toner supplied to the developing roller 17 is regulated in its layer thickness and is triboelectrically charged by the developing blade 21 at one time. As a result, toner coating having a desired layer thickness is formed on the developing roller 17.

The toner which is regulated by the developing blade 21 and which is not carried by the developing roller 17 drops by gravitation. Then, this toner is accommodated (retained) in a second retaining portion 15*b* which is a region (space) below the developing roller 17 and the supplying roller 20 (i.e., below the nip N) in the developing chamber 15. The supplying roller 20 is released from a press-contact state with the developing roller 17 at the instant when a press-contact portion thereof passed through the nip N. At this time, the supplying roller 20 includes the foam member layer 20*b* as the surface layer, and therefore is capable of absorbing the toner from the second retaining portion 15*b* toward an inside thereof. The toner retained by the supplying roller 20 is fed toward a side upstream of the nip N along the rotational direction of the supplying roller 20, so that the toner is accommodated (retained) in the first retaining portion 15*a* in the above-described manner. Incidentally, a part of the toner in the second retaining portion 15*b* is fed by the rotation of the supplying roller 20 in a direction toward the opening 30*a* of the partitioning member 30 which partitions between the developing chamber 15 and the accommodating chamber 18. Then, the toner passes through the opening 30*a* and returns to the accommodating chamber 18.

Figure 4:
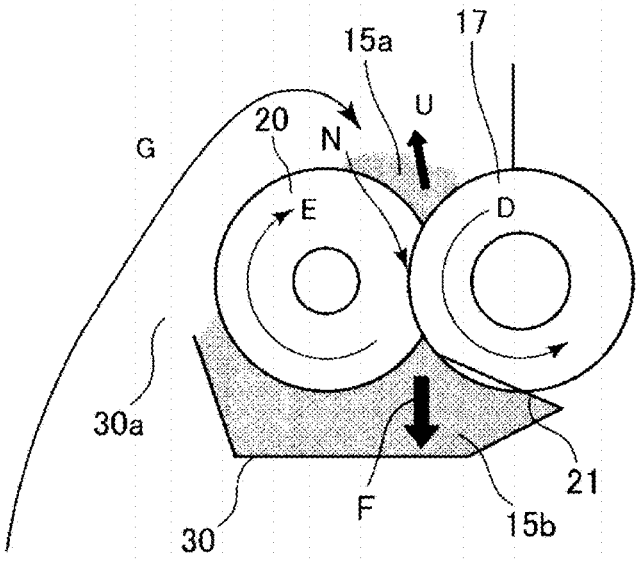
Fig. 4 (Prior Art)
FIG. 4 is an enlarged sectional view of a developing device in Comparison Example 1.

Here, FIG. 4 is a schematic sectional view showing a flow of the toner in the developing chamber 15 in a conventional constitution (Comparison Example 1 described later) disclosed in JP-A 2015-92279. The constitution shown in FIG. 4 is different from this embodiment in that the auxiliary retaining member 88 specifically described later is not provided. By study of the present inventors, in the conventional constitution shown in FIG. 4, it turned out that when the rotational speed of the supplying roller 20 increases, it becomes difficult for the supplying roller 20 to stably absorb (inhale) and retain the toner.

Figure 5:
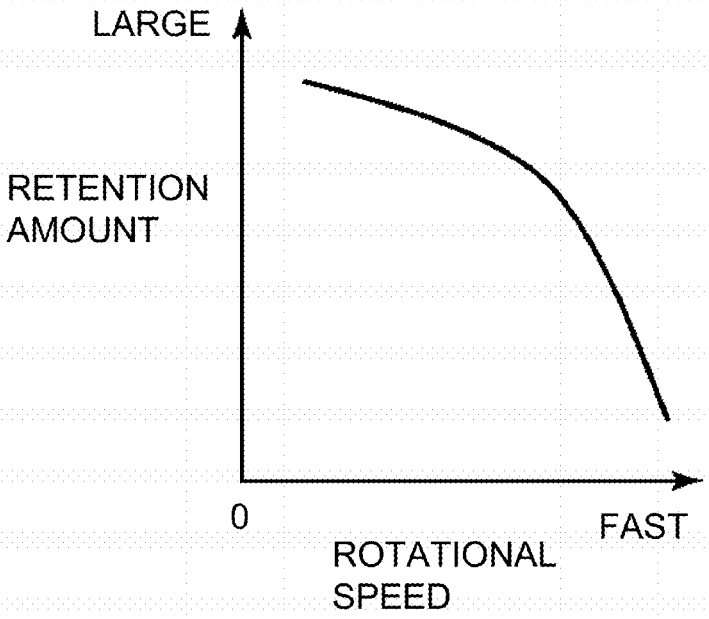
Fig. 5 (Prior Art)
FIG. 5 is a graph showing a relationship between a rotational speed of a supplying member and a toner retaining amount in Comparison Example 1.

FIG. 5 shows a relationship between the rotational speed of the supplying roller 20 and a toner retaining amount of the supplying roller 20 in the constitution shown in FIG. 4. As shown in FIG. 5, in the constitution shown in FIG. 4, there is a tendency that the amount of the toner capable of being retained by the supplying roller 20 decreases with an increasing rotational speed of the supplying roller 20. This may be attributable to the following reason. That is, with the increasing rotational speed of the supplying roller 20, an air velocity (speed) with respect to an arrow F direction (direction from the nip N toward below the nip N) in FIG. 4 in the second retaining portion 15*b* of the developing chamber 15 cannot be neglected. It would be considered that this is attributable to blowing-out of the toner from the supplying roller 20 during the release of the supplying roller 20 from the press-contact state with the developing roller 17. As a result, the toner existing in a side downstream of the nip N with respect to the rotational direction of the supplying roller 20 is scattered in the above-described F direction, so that it becomes difficult for the supplying roller 20 to stably absorb an ambient toner.

As regards this phenomenon, it would be considered that the amount of the toner supplied to the neighborhood of the supplying member is increased by increasing the rotational speed of the feeding member for scooping up the toner from the accommodating portion or by increasing the number of feeding portions (such as sheets) of the feeding member. However, in that case, a driving torque is liable to increase, so that the increased driving torque leads to an increase in power consumption of the image forming apparatus such that there is a need to provide a driving motor having a high torque performance in the apparatus main assembly.

Therefore, in this embodiment, as shown in FIG. 3, the auxiliary retaining member 88 which is a rotatable member is provided in the second retaining portion 15*b* which is the region (space) below the developing roller 17 and the supplying roller 20 (i.e., below the nip N) in the developing chamber 15. That is, in this embodiment, inside the developing chamber 15, the auxiliary retaining member 88 for moving the toner existing in the second retaining portion toward the nip N is disposed downstream of the nip N with respect to the rotational direction of the supplying roller 20.

In this embodiment, the auxiliary retaining member 88 is constituted by including a rotation shaft (supporting member) 88*a* and a flexible sheet member 88*b* which is mounted on the rotation shaft 88*a* and which is rotatable about the rotation shaft 88*a*. Typically, a rotation center of the rotation shaft 88*a* positions between a vertical line passing through a rotation center of the supplying roller 20 and a vertical line passing through a rotation center of the developing roller 17, and particularly in this embodiment, is positioned substantially just (right) below the nip N. The rotation shaft 88*a* is disposed with a predetermined interval (distance) from each of the supplying roller 20 and the developing roller 17 so as to oppose each of the supplying roller 20 and the developing roller 17. The rotational axis direction of the rotation shaft 88*a* is substantially parallel to the rotational axis directions of the supplying roller 20 and the developing roller 17, and opposes the supplying roller 20 and the developing roller 17 in a substantially entire region with respect to an associated rotational axis direction of the supplying roller 20 and the developing roller 17. In this embodiment, the rotation shaft 88*a* has a cylindrical shape which is 3 mm in outer diameter. The sheet member 88*b* is a continuous sheet (plate-shaped member) extending over a substantially entire region with respect to the rotational axis direction of the rotation shaft 88*a*. The sheet member 88*b* is mounted on the rotation shaft 88*a* at one end portion thereof with respect to a direction (rotation radius direction) substantially perpendicular to the rotational axis direction of the rotation shaft 88*a*. In this embodiment, 8 sheet members 88*b* are provided along a circumferential direction of the rotation shaft 88*a*, and are disposed with phases which are shifted by 45° between adjacent two sheet members. In this embodiment, a material of the sheet members 88*b* is a polycarbonate (PC) film, and each of the sheet members 88*b* is 3 mm in free length and 150 μm in thickness. In this embodiment, the auxiliary retaining member 88 is disposed so that the sheet members 88*b* do not contact the supplying roller 20 and the developing roller 17 during rotation thereof and during a rest state thereof.

The auxiliary retaining member 88 is rotationally driven in an indicated arrow H direction (clockwise direction) in FIG. 3 by transmitting a driving force to the rotation shaft 88*a*. That is, in this embodiment, the rotational direction of the auxiliary retaining member 88 is a counter direction to the rotational direction of the supplying roller 20, so that the auxiliary retaining member 88 and the supplying roller 20 rotate so as to move in opposite directions at an opposing portion therebetween. Further, in this embodiment, the rotational speed of the auxiliary retaining member 88 is set at a value substantially equal to the rotational speed of the supplying roller 20.

The rotation shaft 88*a* of the auxiliary retaining member 88 is connected with a driving gear (not shown) of the developing unit 4 and is rotationally driven by the driving motor provided in the apparatus main assembly 100A. In this embodiment, a single drive inputting means for inputting the driving force to the developing unit 4 is used. The developing roller 17, the supplying roller 20, the feeding member 22 and the auxiliary retaining member 88 are connected with gears (not shown), and are rotationally driven in synchronism with each other during image formation and the like. As a result, during the rotational drive of the supplying roller 20, the feeding member 22 supplies the toner and thus it is possible to promote circulation of the toner between the developing chamber 15 and the accommodating chamber 18. Further, during the rotational drive of the supplying roller 20, the auxiliary retaining member 88 rotates, so that retention of the toner by the supplying roller 20 can be assisted.

Thus, by disposing the auxiliary retaining member 88 in the side downstream of the nip N with respect to the rotational direction of the supplying roller 20, a toner flow direction indicated by the arrow F in FIG. 3 is changed, so that the absorption (inhalation) of the toner by the supplying roller 20 can be promoted. As a result, even when the rotational speed of the supplying roller 20 increases, a lowering in toner retaining amount of the supplying roller 20 is suppressed, with the result that the supply of the toner to the nip N by the supplying roller 20 can be made stably. That is, as described above, in order to meet speed-up of the image forming speed, the rotational speed of the supplying roller 20 is increased in some cases. In these cases, the toner retaining amount of the supplying roller 20 lowers due to an increasing pressure of the air blowing from the supplying roller 20 in the side downstream of the nip N with respect to the rotational direction of the supplying roller 20, so that the supplying roller 20 is in a situation such that the amount of the toner supplied to the developing roller 17 is liable to be lower. Even in such a situation, by disposing the auxiliary retaining member 88 in the side downstream of the nip N with respect to the rotational direction of the supplying roller 20, the toner scooped up from the accommodating portion 18*a* to the neighborhood of the supplying roller 20 can be retained efficiently by the supplying roller 20. Therefore, according to this embodiment, the toner can be stably supplied to the nip N by the supplying roller 20 with a simple constitution while suppressing an increase in power consumption for scooping up the toner from the accommodating portion 18*a*.

In this embodiment, the thickness of the sheet member 88*b* may suitably be 100 μm-250 μm, but is not limited thereto. It is only required that the sheet member 88*b* can sufficiently withstand the pressure of the toner blowing from the nip N and can sufficiently assist the retention of the toner by the supplying roller 20. In the constitution in this embodiment, it was suitable that the rotational direction of the auxiliary retaining member 88 is counterdirectionally to the rotational direction of the supplying roller 20 at their opposing portion, but the rotational direction and the rotational speed of the auxiliary retaining member 88 are also not limited to those in this embodiment. The rotational direction and the rotational speed of the auxiliary retaining member 88 can be appropriately set depending on the constitution of the auxiliary retaining member 88 and the like so that the auxiliary retaining member 88 can stably feed the toner to the region (in the neighborhood of an exit of the nip N), where the absorption (inhalation) of the toner by the supplying roller 20 is made, in the side downstream of the nip N with respect to the rotational direction of the supplying roller 20.

Further, in this embodiment, as the auxiliary retaining member 88, the auxiliary retaining member having the constitution in which the sheets are mounted on the rotation shaft was used, but the auxiliary retaining member 88 is not limited thereto. For example, as the auxiliary retaining member 88, a rotatable roller including a foam member (porous member) as a surface layer thereof may also be used similarly as in the case of the supplying roller 20.

4. Evaluation Experiment

In order to confirm an effect of this embodiment, the following experiment was conducted for Embodiment 1 having a constitution according to the First Embodiment and for Comparison Example 1 having the following constitution.

Comparison Example 1

FIG. 4 is an enlarged schematic sectional view showing an inside of a developing chamber 15 in a developing unit 4 in Comparison Example 1. In Comparison Example 1, the auxiliary retaining member 88 is not provided in the developing unit 4. Constitutions and operations of the developing unit 4, a process cartridge 7 and an image forming apparatus 100 in Comparison Example 1 are the same as those in Embodiment 1 except that the auxiliary retaining member 88 is not provided. In Comparison Example 1, elements having the same or corresponding functions and constitutions as those in Embodiment 1 are represented by the same reference numerals or symbols.

<Contents of Experiment>

As evaluation of density stability of a solid image, an image density lowering amount when a printing (solid image) was continuously effected was measured. The evaluation was made after the image forming apparatus 100 was left standing for 1 day and adapted in an environment of a low-temperature and low-humidity condition (temperature: 15° C., humidity: 10% RH) and then a horizontal line image with an image ratio 5% was continuously printed on 1000 sheets. Specifically, as an evaluation image, the solid image was continuously outputted on 10 sheets, and a density difference between a leading end portion and a trailing end portion of the solid image on the 10-th sheet with respect to a recording material feeding direction was measured using a spectrodensitometer 500 (manufactured by X-Rite Inc.), and then was evaluated according to an evaluation criterion described later. A similar experiment was conducted by changing the process speed to 330 mm/sec, 250 mm/sec, 200 mm/sec and 100 mm/sec (4 levels).

The process speed of the image forming apparatus 100 is represented by a peripheral speed of the photosensitive drum 1. In the constitution in this embodiment, the peripheral speed of the photosensitive drum 1 and the peripheral speed of the developing roller 17 are substantially equal to each other. Further, irrespective of the process speed, a ratio between the rotational speed of the developing roller 17 and the rotational speed of the supplying roller 20 (in this embodiment, the rotational speed of the supplying roller 20 is twice the rotational speed of the developing roller 17) was set at a constant value. Further, irrespective of the process speed, the rotational speed of the supplying roller 20 and the rotational speed of the auxiliary retaining member 88 were set so as to be substantially equal to each other.

(Evaluation Criterion)

○: In a solid black image, a density difference between the leading and trailing end portions was less than 0.1.

Δ: In the solid black image, the density difference was 0.1 or more and less than 0.3.

x: In the solid black image, the density difference was 0.3 or more.

<Result of Experiment>

An Evaluation results of Embodiment 1 and Comparison Example 1 are shown in Table 1 appearing hereinafter.

In Comparison Example 1, the density stability of the solid image lowered with an increasing process speed. This would be considered because a toner retaining amount of the supplying roller 20 lowered in the side downstream of the nip N with respect to the rotational direction of the supplying roller 20 with the increasing process speed.

On the other hand, in Embodiment 1, a stable solid image was capable of being outputted irrespective of the process speed. This would be considered because a lowering in toner retaining amount of the supplying roller 20 did not generate even when the process speed increased.

Thus, according to this embodiment, the auxiliary retaining member 88 is disposed in the side downstream of the nip N with respect to the rotational direction of the supplying roller 20, i.e., in the neighborhood of the region where the absorption of the toner by the supplying roller 20 is made. Then, the toner is stably fed to the region where the absorption of the toner by the supplying roller 20 is made in the side downstream of the nip N with respect to the rotational direction of the supplying roller 20. As a result, even when the rotational speed of the supplying roller 20 increases, the lowering in toner retaining amount of the supplying roller 20 is suppressed, with the result that it becomes possible to stably supply the toner to the nip N by the supplying roller 20.

As described above, according to this embodiment, in the constitution in which the toner accommodating portion 18*a* is disposed below the supplying roller 20, the developer can be stably supplied from the supplying roller 20 to the developing roller 17.

Second Embodiment (Embodiment 2)

The Second Embodiment of the present invention will be described. Basic constitutions and operations of a developing device, a process cartridge and an image forming apparatus are the same as those in the First Embodiment. Accordingly, in this embodiment, elements having the same or corresponding functions and constitutions which are the same as those in the First Embodiment are represented by the same reference numerals or symbols and will be omitted from detailed description.

1. Constitution of this Embodiment

Figure 6:
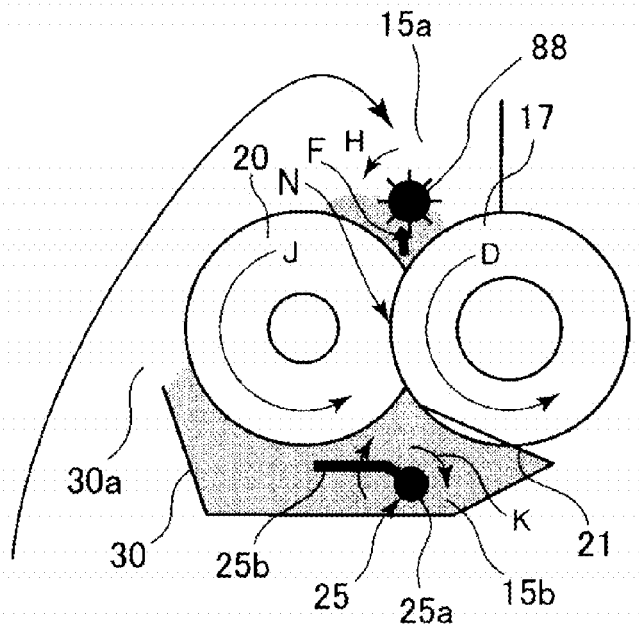
FIG. 6 is an enlarged sectional view of a developing device in a Second Embodiment (Embodiment 2).

FIG. 6 is an enlarged schematic sectional view showing an inside of a developing chamber 15 in a developing unit 4 in this embodiment. In this embodiment, a supplying roller 20 and a developing roller 17 are rotationally driven so that their surfaces move in opposite directions at a nip N. In this embodiment, the supplying roller 20 is rotationally driven so that its surface moves from below to above at the nip N (arrow J direction), and the developing roller 17 is rotationally driven so that its surface moves from above to below at the nip N (arrow D direction). That is, the rotational direction of the developing roller 17 is the same as that in the First Embodiment, but the rotational direction of the supplying roller 20 is different from that in the First Embodiment.

In this embodiment, a stirring member 25 is provided in the second retaining portion 15*b* which is the region (space) positioned below the developing roller 17 and the supplying roller 20 (i.e., below the nip N) in the developing chamber 15. That is, in this embodiment, inside the developing chamber 15, the stirring member 25 for stirring the developer in the second retaining portion 15*b* is disposed in a side upstream of the nip N with respect to the rotational direction of the supplying roller 20. The stirring member 25 is constituted by including a stirring supporting shaft 25*a* and a stirring portion 25*b* mounted on the stirring supporting shaft 25*a*, and is disposed opposed to the supplying roller 20. The stirring supporting shaft 25*a* is rotatably supported by the developing frame 16 at its longitudinal end portions, and has a crank shape such that its longitudinal central portion is positioned outside its rotation center with respect to a rotation radius direction. Typically, the rotation center of the stirring supporting shaft 25*a* is positioned between a vertical line passing through the rotation center of the supplying roller 20 and a vertical line passing through the rotation center of the developing roller 17, and is positioned substantially just below the nip N in this embodiment. The stirring portion is a continuous sheet (plate-shaped member) extending over a substantially entire region with respect to the rotational axis direction of the stirring supporting shaft 25*a*. The stirring portion 25*b* is rotatably connected with the longitudinal central portion of the stirring supporting shaft 25*a* (eccentric position relative to the rotation center of the stirring supporting shaft 25*a*) at one end portion thereof with respect to a direction (rotation radius direction) substantially perpendicular to the rotational axis direction of the stirring supporting shaft 25*a*. As a result, the stirring portion 25*b* is swung in interrelation with rotation of the stirring supporting shaft 25*a*. In this embodiment, the stirring supporting shaft 25*a* is positioned downstream of the stirring portion 25*b* with respect to the rotational direction of the supplying roller 20. As a result, motion of the stirring portion 25*b* can be made larger in a downstream side than in an upstream side with respect to the rotational direction of the supplying roller 20.

In this embodiment, an auxiliary retaining member 88 is provided in the first retaining portion 15*a* which is the region (space) positioned above the developing roller 17 and the supplying roller 20 (i.e., above the nip N) in the developing chamber 15. That is, in this embodiment, inside the developing chamber 15, the auxiliary retaining member 88 for moving the toner in the first retaining portion 15*a* toward the nip N in the side downstream of the nip N with respect to the rotational direction of the supplying roller 20. Incidentally, a constitution, an arrangement (a positional relationship relative to the developing roller 17 and the supplying roller 20), a rotational direction (relative to the rotational direction of the supplying roller 20), and a rotational speed of the auxiliary retaining member 88 are the same as those in the First Embodiment.

2. Flow of Toner

A flow of the toner in the developing chamber 15 in this embodiment will be described with reference to FIG. 6.

The toner accommodated in the accommodating chamber 18 is flipped up by the feeding member 22 along a flying locus shown by an arrow G. Most of the toner is supplied to a first retaining portion 15*a* which is a region (space) on the supplying roller 20 and on the developing roller 17 and the supplying roller 20 (i.e., above the nip N) in the developing chamber 15. In this embodiment, the first retaining portion

15*a* is positioned downstream of the nip N with respect to the rotational direction of the supplying roller 20. The supplying roller 20 is released from a press-contact state with the developing roller 17 at the instant when a press-contact portion thereof passed through the nip N. At this time, the supplying roller 20 includes the foam member layer 20*b* as the surface layer, and therefore is capable of absorbing the toner from the first retaining portion 15*a* toward an inside thereof.

In this embodiment, the supplying roller 20 rotates, as shown as an arrow J direction in the figure, in a direction in which its surface moves from above at an opposing portion to the opening 30*a* (FIG. 2). That is, the supplying roller 20 rotates so as to take in (absorb) the toner supplied to the developing chamber 15 through the opening 30*a* downwardly along the partitioning member 30. As a result, the supplying roller 20 feeds not only the toner retained therein but also the toner supplied to the developing chamber 15 toward the second retaining portion 15*b* which is the region (space) positioned below the developing roller (developing sleeve) 17 and the supplying roller 20 (i.e., below the nip N) in the developing chamber 15. In the second retaining portion 15*b*, the stirring member 25 is disposed. The rotation supporting shaft 25*a* of the stirring member rotates in an indicated arrow K direction in the figure, so that the toner existing in the second retaining portion 15*b* is pressed against the supplying roller 20 by the stirring portion 25*b* of the stirring member 25. As a result, an amount of the toner supplied to the supplying roller 20 is increased, so that it is possible to increase the amount of the toner supplied to the nip N.

The toner fed to the nip N by the rotation of the supplying roller 20 is supplied with electric charges by sliding between the developing roller 17 and the supplying roller 20. A part of the toner having the electric charges is electrostatically attracted to the developing roller 17. Thus, the toner is supplied from the supplying roller 20 to the developing roller 17. Further, a part of the toner supplied to the developing roller 17 is not only regulated in its layer thickness but also triboelectrically charged. As a result, toner coating with a desired layer thickness is formed on the developing roller 17.

Further, the toner which is regulated by the developing blade 21 and which is not carried by the developing roller 17 drops by gravitation and is accommodated (retained) in the second retaining portion 15*b*. Further, the supplying roller 20 is compressedly deformed immediately in front of the nip N with the developing roller 17, and by the deformation, a part of the toner accumulated at the surface and the inside of the supplying roller 20 is discharged. Also the discharged toner is accommodated (retained) in the second retaining portion 15*b*.

3. Evaluation Experiment

In order to confirm an effect of this embodiment, an experiment similar to the experiment described in the First Embodiment was conducted for Embodiment 2 having a constitution according to the First Embodiment and for Comparison Example 2 having the following constitution.

Comparison Example 2

Figure 7:
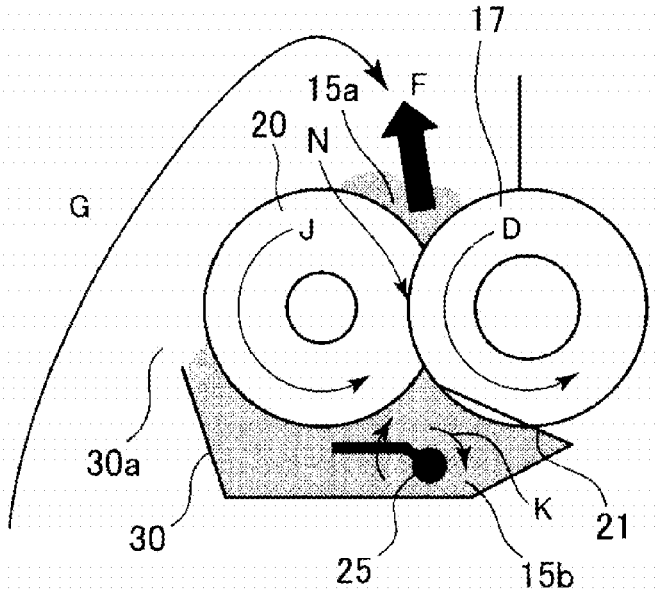
FIG. 7 is an enlarged sectional view of a developing device in Comparison Example 2.

FIG. 7 is an enlarged schematic sectional view showing an inside of a developing chamber 15 in a developing unit 4 in Comparison Example 2. In Comparison Example 2, the auxiliary retaining member 88 is not provided in the developing unit 4. Constitutions and operations of the developing unit 4, a process cartridge 7 and an image forming apparatus 100 in Comparison Example 2 are the same as those in Embodiment 2 except that the auxiliary retaining member 88 is not provided. In Comparison Example 2, elements having the same or corresponding functions and constitutions as those in Embodiment 2 are represented by the same reference numerals or symbols.

<Contents of Experiment>

Contents of an evaluation experiment are the same as those described in the First Embodiment.

<Result of Experiment>

An Evaluation results of Embodiment 2 and Comparison Example 2 are shown in Table 1 appearing hereinafter.

In Comparison Example 1, the density stability of the solid image lowered with the increasing process speed. In Comparison Example 2, it turned out that there was a tendency that the density stability of the solid image further lowered with the increasing process speed compared with that in Comparison Example 1. This would be considered for the following reason. That is, compared with the toner in the second retaining portion 15*b* in Comparison Example 1, the toner in the first retaining portion 15*a* in Comparison Example 2 is liable to scatter in an indicated arrow F direction in the figure (in a direction from the nip N toward above) with the increasing process speed. For that reason, it would be considered that in Comparison Example 2, the supplying roller 20 does not readily absorb the toner compared with Comparison Example 1.

On the other hand, in Embodiment 2, by disposing the auxiliary retaining member 88, similarly as in Embodiment 1, it was possible to output a stable solid image irrespective of the process speed.

As described above, according to this embodiment, even in the constitution in which the lowering in toner retaining amount of the supplying roller 20 with an increase in rotational speed of the supplying roller 20 is liable to generate, similarly as in the First Embodiment, the developer can be stably supplied from the supplying roller 20 to the developing roller 17.

Third Embodiment (Embodiment 3)

The Third Embodiment of the present invention will be described. Basic constitutions and operations of a developing device, a process cartridge and an image forming apparatus are the same as those in the First and Second Embodiments. Accordingly, in this embodiment, elements having the same or corresponding functions and constitutions which are the same as those in the First and Second Embodiments are represented by the same reference numerals or symbols and will be omitted from detailed description.

1. Constitution of this Embodiment

Figure 8:
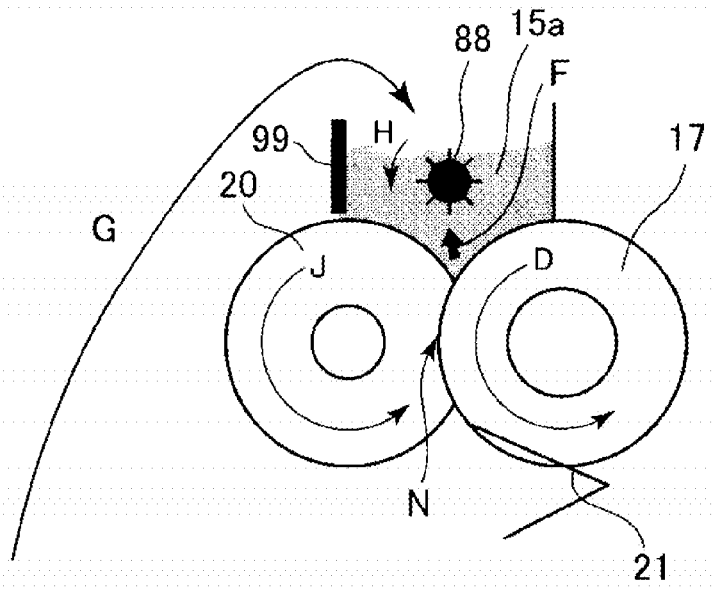
FIG. 8 is an enlarged sectional view of a developing device in a Third Embodiment (Embodiment 3).

FIG. 8 is an enlarged schematic sectional view showing the neighborhood of a developing roller 17 and a supplying roller 20 in a developing unit 4 in this embodiment. The developing unit 4 in this embodiment roughly has the same constitution as the developing unit 4 in the Second Embodiment, but is different from the Second Embodiment in that the partitioning member 30 and the stirring member 25 are not provided but a retaining member 99 is provided as described later.

That is, in the case where the developer is supplied to the developer carrying member or the like against gravitation, in order to improve a toner circulating property between the neighborhood of the developer carrying member and a toner accommodating portion, a constitution in which the partitioning member for partitioning between the developing chamber and the accommodating chamber is not provided may desirably employed. Particularly, it is desirable that the partitioning member for partitioning between the developing chamber and the accommodating chamber at a position below the supplying member, i.e., below the nip between the supplying member and the developer carrying member is not provided. In other words, it is desirable that a member for preventing movement of the developer, which is not carried by the developer carrying member and which drops from the developer carrying member, to the accommodating portion is not provided.

Therefore, in this embodiment, a constitution in which the partitioning member 30 for partitioning between the developing chamber 15 and the accommodating chamber 18 in the Second Embodiment is not provided is employed. That is, in this embodiment, in the developing unit 4, a toner accommodating portion 18*a* is formed at a lower portion of a substantially single contained constituted by the developing frame 16. The toner fed from the accommodating portion 18*a* toward the supplying roller 20 similarly as in the Second Embodiment is retained in the first retaining portion 15*a*. On the other hand, in the region (space) positioned below the supplying roller 20 and the developing roller 17, the toner which is regulated by the developing blade 21 and which drops from the developing roller 17 is returned to the accommodating portion 18*a* without being blocked by the partitioning member. Thus, in this embodiment, the second retaining portion 15*b* and the stirring member 25 disposed in the second retaining portion 15*b* are not provided.

On the other hand, in this embodiment, the retaining member 99 is disposed above the nip N. Particularly, in this embodiment, the retaining member 99 is disposed so that its lower end opposes an upper end (top) of the supplying roller 20 and is close to the upper end of the supplying roller 20 with a predetermined gap (distance) therebetween. The retaining member 99 may also be contacted to the supplying roller 20. In this embodiment, a length of the retaining member 99 with respect to a longitudinal direction of the retaining member 99 (parallel to the rotational axis directions of the developing roller 17 and the supplying roller 20) is equal to a full length between inner walls at longitudinal end portions of the developing frame 16. However, the longitudinal length of the retaining member 99 may also be shorter than that between the inner walls, and in this case, it is desirable that the retaining member 99 is disposed in a range including a central portion between the inner walls. An upper end of the retaining member 99 does not reach an upper inner wall of the developing frame 16, so that the toner fed by the feeding member 22 gets over the upper end of the retaining member 99 and thus can be supplied above the nip N. In this embodiment, as the retaining member 99, a plastic plate was used. Thus, the retaining member 99 is disposed in proximity to or in contact with the supplying roller 20 in a side downstream of the nip N with respect to the rotational direction of the supplying roller 20. Further, the retaining member 99 prevents at least a part of movement of the toner existing in the first retaining portion 15*a* in the rotational direction of the supplying roller 20. The retaining member 99 can increase an amount of the toner retained in the first retaining portion 15*a* when compared with the case where the retaining member 99 is not provided. A material and a shape of the retaining member 99 are not limited to those in this embodiment, but it is only required to employ a constitution in which the toner can be accumulated in the first retaining portion 15*a*.

In this embodiment, similarly as the Second Embodiment, the auxiliary retaining member 88 is disposed in the first retaining portion 15*a*. A constitution, a rotational direction and a rotational speed of the auxiliary retaining member 88 are the same as those in the First Embodiment.

2. Evaluation Experiment

In order to confirm an effect of this embodiment, an experiment similar to the experiment described in the First Embodiment was conducted for the Embodiment 3 having a constitution according to the First Embodiment and for Comparison Example 3 having the following constitution.

Comparison Example 3

Figure 9:
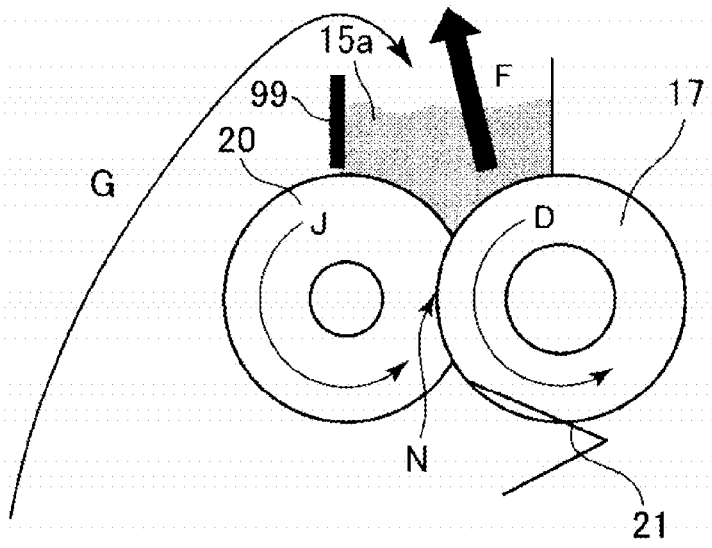
FIG. 9 is an enlarged sectional view of a developing device in Comparison Example 3.

FIG. 9 is an enlarged schematic sectional view showing the neighborhood of a developing roller 17 and a supplying roller 20 in a developing unit 4 in Comparison Example 3. In Comparison Example 3, the auxiliary retaining member 88 is not provided in the developing unit 4. Constitutions and operations of the developing unit 4, a process cartridge 7 and an image forming apparatus 100 in Comparison Example 3 are the same as those in Embodiment 3 except that the auxiliary retaining member 88 is not provided. In Comparison Example 3, elements having the same or corresponding functions and constitutions as those in Embodiment 3 are represented by the same reference numerals or symbols.

<Contents of Experiment>

Contents of an evaluation experiment are the same as those described in the First Embodiment.

<Result of Experiment>

An Evaluation results of Embodiment 3 and Comparison Example 3 are shown in Table 1 appearing hereinafter.

In Comparison Example 1, the density stability of the solid image lowered with the increasing process speed. In Comparison Example 3, it turned out that there was a tendency that the density stability of the solid image further lowered with the increasing process speed compared with those in Comparison Examples 1 and 2. This would be considered for the following reason. That is, compared with the toner in the second retaining portion 15*b* in Comparison Example 1, the toner in the first retaining portion 15*a* in Comparison Example 3 is liable to scatter in an indicated arrow F direction in the figure (in a direction from the nip N toward above) with the increasing process speed. For that reason, it would be considered that in Comparison Example 3, the supplying roller 20 does not readily absorb the toner compared with Comparison Example 1. Further, in Comparison Example 3, there is no second retaining portion 15*b*, so that a surface area of the supplying roller 20 contacting the toner is considerably decreased compared with Comparison Example 2. For that reason, it would be considered that a degree of the lowering in amount of the toner fed to the nip N due to the lowering in toner retaining amount at the first retaining portion 15*a* becomes more conspicuous than in Comparison Example 2.

On the other hand, in Embodiment 3, by disposing the auxiliary retaining member 88, similarly as in Embodiments 1 and 2, it was possible to output a stable solid image irrespective of the process speed.

As described above, according to this embodiment, even in the constitution in which the lowering in toner retaining amount of the supplying roller 20 with an increase in rotational speed of the supplying roller 20 is liable to generate, similarly as in the First Embodiment, the developer can be stably supplied from the supplying roller 20 to the developing roller 17.

TABLE 1

| | 330 (mm/sec) | 250 (mm/sec) | 200 (mm/sec) | 100 (mm/sec) |
|---|---|---|---|---|
| EMB. 1 | ○ | ○ | ○ | ○ |
| EMB. 2 | ○ | ○ | ○ | ○ |
| EMB. 3 | ○ | ○ | ○ | ○ |
| COMP. EX. 1 | x | Δ | ○ | ○ |
| COMP. EX. 2 | x | x | ○ | ○ |
| COMP. EX. 3 | x | x | x | ○ |

Other Embodiments

The present invention was described above based on the embodiments, but is not limited thereto.

In the above-described embodiments, the image forming apparatus capable of forming the color image was described as an example, but even an image forming apparatus capable of forming a monochromatic image can obtain a similar effect.

Further, in the above-described embodiments, as the image forming apparatus, the printer was described as an example, but the present invention is not limited thereto. For example, even other image forming apparatuses such as a copying machine, a facsimile machine and a multi-function machine having a combination of functions of these machine can obtain a similar effect. Further, even an image forming apparatus in which a recording material carrying member is used and respective color toner images are successively transferred superposedly from the recording material carrying member onto a recording material can obtain a similar effect.

Fourth Embodiment (Embodiment 4)

1. General Structure of Process Cartridge

The Fourth Embodiment of the present invention will be described. Basic constitutions and operations of a developing device, a process cartridge and an image forming apparatus are the same as those in the First Embodiment. Accordingly, in this embodiment, elements having the same or corresponding functions and constitutions which are the same as those in the First Embodiment are represented by the same reference numerals or symbols and will be omitted from detailed description.

1. Constitution of this Embodiment

Figure 11:
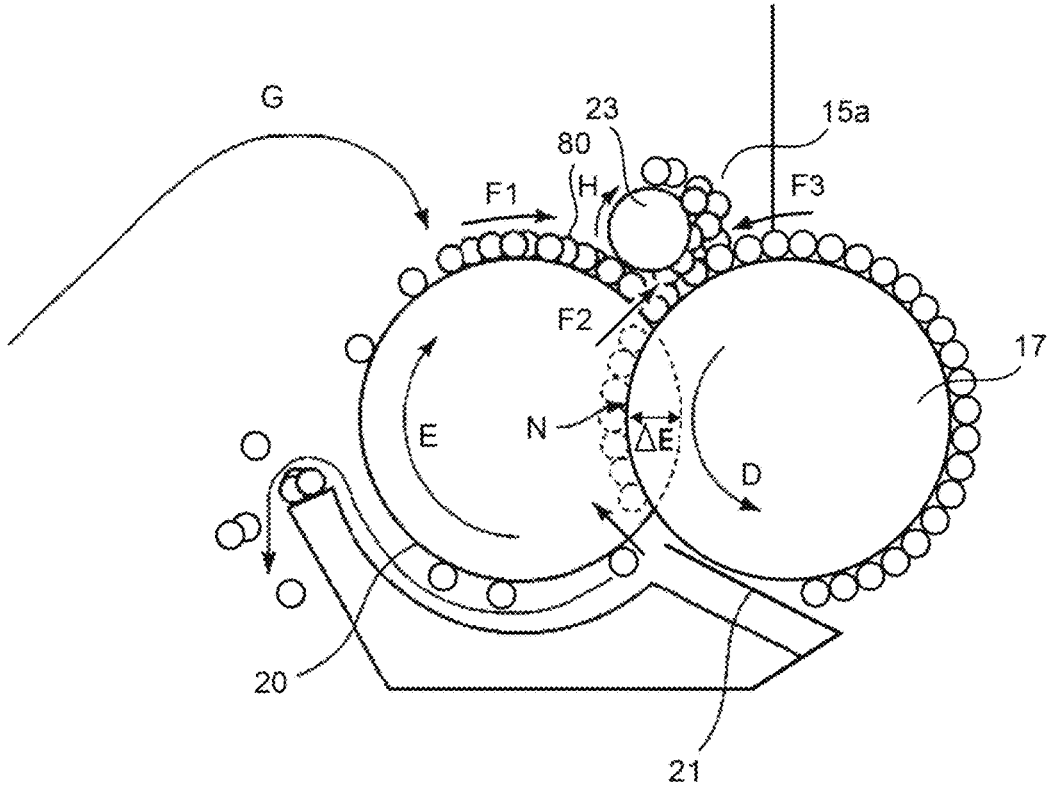
FIG. 11 is an enlarged schematic sectional view of a developing chamber of a developing device in the Fourth Embodiment (Embodiment 4).

FIG. 11 is an enlarged schematic sectional view showing an inside of a developing chamber 15 in a developing unit 4 in this embodiment. In this embodiment, above the nip N, an auxiliary supplying member 23 which is a rotatable member for assisting supply of the toner from the supplying roller 20 to the developing roller 17 is provided. The auxiliary supplying member 23 is an elastic sponge roller which is prepared by forming, as an elastic layer, a foam member layer 23*b* in a roller shape on an outer peripheral surface of an electroconductive core metal 23*a* and which is 10 mm in outer diameter. Typically, the rotation center of the auxiliary supplying member 23 is positioned between a vertical line passing through the rotation center of the supplying roller 20 and a vertical line passing through the rotation center of the developing roller 17, and is positioned substantially just above the nip N in this embodiment. The auxiliary supplying member 23 is disposed so as to oppose each of the supplying roller 20 and the developing roller 17 with a predetermined gap (distance) therebetween. This gap may desirably be 5.0 mm or less in order to satisfactorily obtain a toner feeding force described later. The rotational axis direction of the auxiliary supplying member 23 is substantially parallel to the rotational axis directions of the supplying roller 20 and the developing roller 17, and opposes each of the supplying roller 20 and the developing roller 17 over a substantially entire region with respect to the rotational axis direction of each of the supplying roller 20 and the developing roller 17. In this embodiment, the auxiliary supplying member 23 is rotationally driven in an indicated arrow H direction (counterclockwise direction) in the figure. That is, the auxiliary supplying member 23 and the supplying roller 20 are rotationally driven so that their surfaces move in the same direction at an opposing portion therebetween, and the auxiliary supplying member 23 and the developing roller 17 are rotationally driven in opposite directions at the passing portion therebetween. In this embodiment, the auxiliary supplying member 23 is rotationally driven at 50 rpm. That is, in this embodiment, the number of rotations (turns) per unit time of the auxiliary supplying member 23 is lower than that of the supplying roller 20.

The number of rotations per unit time of the auxiliary supplying member 23 can be appropriately set so that the toner feeding force described later can be sufficiently obtained. When the rotation number (per unit time) of the auxiliary supplying member 23 is high more than necessary, the toner can be deteriorated, and therefore may desirably be set so that a sufficient feeding force can be obtained in a range in which the rotation number of the auxiliary supplying member 23 is lower than that of the supplying roller 20. However, the rotation number (per unit time) of the auxiliary supplying member 23 may desirably be higher than that of the feeding member 22.

The feeding member 22 provided in the accommodating chamber 18 not only stirs the toner accommodated in the accommodating chamber 18 by rotation thereof but also feeds the toner toward above the supplying roller 20 and the nip N along an arrow G direction shown in FIG. 11. In this embodiment, the feeding member 23 is rotationally driven at 30 rpm. That is, in this embodiment, the rotation number (per unit time) of the feeding member 22 is lower than that of the supplying roller 20.

The foam member layer 20*b* of the supplying roller 20 used in this embodiment is constituted by a foam urethane layer of an open-cell type in which air bubbles connect with each other. A surface layer of urethane has the open-cell structure, so that the toner can enter the supplying roller 20 in a large amount. A surface cell diameter of the supplying roller 20 may preferably be about 50 μm to about 1000 μm. Here, the cell diameter refers to an average diameter of foam cell in an arbitrary cross-section. First, from an enlarged image of the arbitrary cross-section, an area of a maximum foam cell is measured and is converted into a true-circle corresponding diameter, so that a maximum cell diameter is acquired. Then, foam cells having diameters which are not more than ½ of the maximum cell diameter are deleted as noise, and thereafter an average of cell diameters similarly converted from remaining cell areas is acquired and is used as the cell diameter. Incidentally, also a foam member layer of the auxiliary supplying member 23 can have the same constitution as the foam member layer 20*b* of the supplying roller 20.

In addition, in this embodiment, the toner having a degree of agglomeration of 5-40% in an initial state. In order to obtain good toner flowability throughout a lifetime period of the developing unit 4 (or the process cartridge 7), it is desirable that the toner having the degree of agglomeration of 5-40% is used. The degree of agglomeration of the toner was measured in the following manner. As a measuring device, a powder tester (manufactured by Hosokawa Micron Corp.) equipped with a digital vibration meter ("MODEL 1332", manufactured by Showasokki Co., Ltd.) was used. A measuring method is as follows. On a vibration table, sieves with 390 mesh, 200 mesh and 100 mesh in opening were placed in a decreasing mesh order, i.e., in a named order so that the 100-mesh sieve is placed at an upper most position. Onto the 100-mesh sieve, 5 g of accurately weighed sample (toner) was added and a displacement value of the digital vibration meter was adjusted to 0.60 mm (peak-to-peak), and then was subjected to vibration for 15 sec. Then, a weight of the sample remaining on each of the three sieves was measured, and then the degree of agglomeration was calculated according to an equation below. The sample for the measurement was left standing for 24 hours in an environment of 23° C. in temperature and 60% RH in humidity, and the measurement was made in the environment (23° C., 60% RH).

Degree of agglomeration (%)=(Remaining sample weight on 100-mesh sieve/5 g)×100+(Remaining sample weight on 200-mesh sieve/5 g)×60+(Remaining sample weight on 390-mesh sieve/5 g)×20.

2. Flow of Toner

Figure 10:
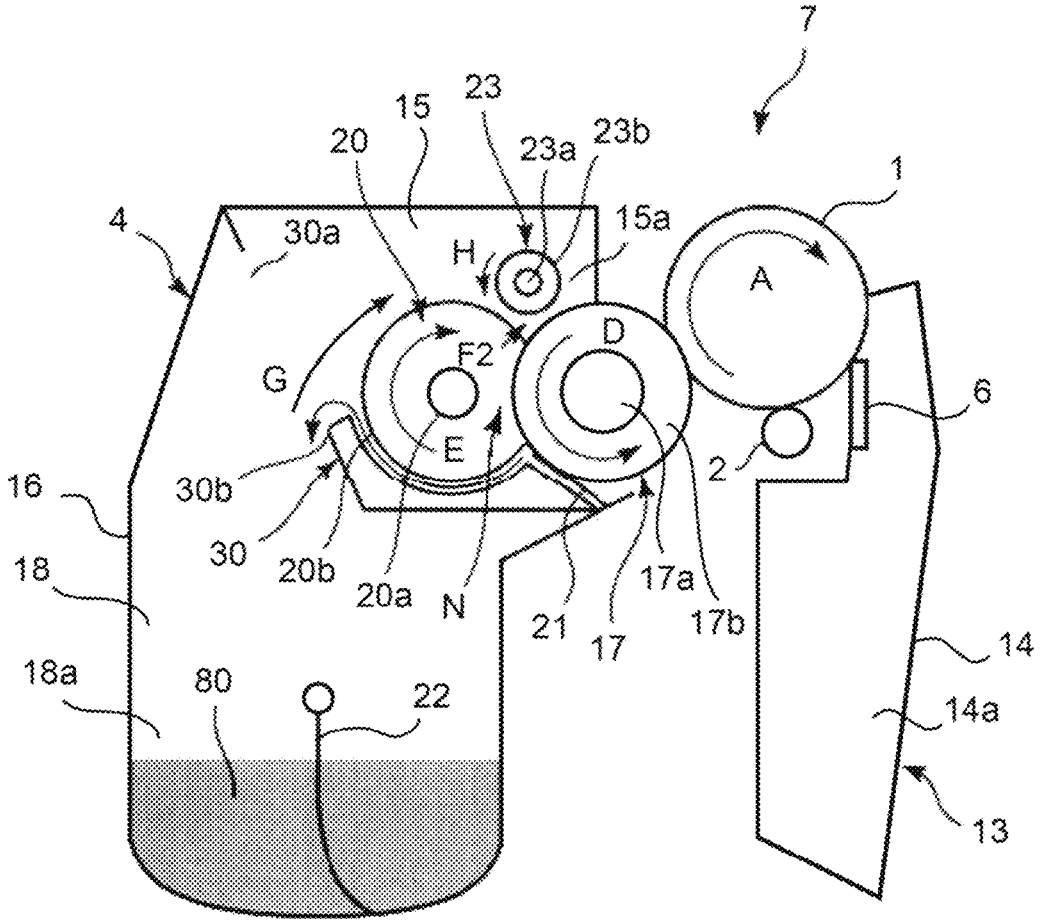
FIG. 10 is a schematic sectional view of a process cartridge in a Fourth Embodiment (Embodiment 4).

A flow of the toner in the developing chamber 15 will be described with reference to FIGS. 10 and 11. FIG. 11 is an enlarged schematic sectional view showing an inside of the developing chamber 15, and shows motion of the toner 80 fed from the accommodating chamber 18 toward the supplying roller 20 by the feeding member 22.

Supply of the toner toward the developing chamber 15 by the feeding member 22 is principally made toward above the supplying roller 20 (arrow G in FIG. 11), and the supplied toner is retained at the surface and the inside of the supplying roller 20. The supplying roller 20 rotates in an indicated arrow E direction in the figure, and therefore the toner retained by the supplying roller 20 is fed toward the nip N with the developing roller 17 (arrow F1 in FIG. 11). Here, a part of the toner T fed by the supplying roller 20 is discharged at an entrance of the nip N by deformation of the supplying roller 20, so that the toner is accumulated and retained in a region (space) positioned above the nip N (arrow F2 in FIG. 11). A space where the toner positioned above the nip N is retained is a retaining portion 15*a*. As a result, in a period from the feeding of the toner toward the developing chamber by the feeding member 22 until the toner is subsequently fed, the toner retained in the retaining portion 15*a* can be stably supplied to the supplying roller 20 and the developing roller 17 so as not to decrease the amount of the toner in the supplying roller 20. Further, inside the retaining portion 15*a*, the auxiliary supplying member 23 is disposed and rotates in an indicated arrow H direction in the figure. As a result, the toner feeding force toward the nip N is enhanced. That is, the auxiliary supplying member 23 is an example of a rotatable member, which is disposed opposed to the supplying roller 20 in the retaining portion 15*a*, for moving the toner in the retaining portion 15*a* toward the nip N.

Then, the toner fed to the nip N is triboelectrically charged in the nip N since the supplying roller 20 and the developing roller 17 rotate with a peripheral speed difference, so that the toner has predetermined electric charges. Then, a part of the toner transfers onto the developing roller 17. In this embodiment, the peripheral speed of the supplying roller 20 is higher than the peripheral speed of the developing roller 17, and therefore an amount of the toner passing onto the developing roller 17 per unit time increases, so that the toner in a larger amount transfers onto the developing roller 17. The toner transferred on the developing roller 17 is not only regulated in its layer thickness by the developing blade 21 but also triboelectrically charged at a regulating portion between the developing roller 17 and the developing blade 21. As a result, uniform toner coating is formed on the developing roller 17 by the toner passed through the regulating portion.

On the other hand, the toner which is regulated by the developing blade 21 and which is not carried by the developing roller 17 is fed by the rotation of the supplying roller 20 in a direction toward the opening 30*a* of the partitioning member 30 which partitions between the developing chamber 15 and the accommodating chamber 18. Then, the toner passes through the opening 30*a* and returns to the accommodating chamber 18.

In this embodiment, a lower end (upper end of an inner surface (bottom) of the developing chamber 15 formed by the partitioning member 30) 30*b* of the opening 30*a* is positioned below the rotation center of the supplying roller 20 by 1 mm. The lower end 30*b* of the opening 30*a* may desirably be disposed below an upper end (top) of the supplying roller 20. As a result, the toner fed toward the opening 30*a* by the supplying roller 20 readily gets over the lower end 30*b* of the opening 30*a*, so that the toner in the developing chamber 15 is readily returned to the accommodating chamber 18. The toner is satisfactorily circulated between the developing chamber 15 and the accommodating chamber 18 and thus deterioration of the toner is suppressed, so that even in the case where an image with a low print ratio is continuously outputted, generation of agglomeration of the toner is suppressed and thus a high-quality image can be stably outputted. Further, as in this embodiment, the lower end 30*b* of the opening 30*a* may desirably be disposed below the rotation center of the supplying roller 20. As a result, the supply of the toner onto the supplying roller 20 by the feeding member 22 can be satisfactorily made.

In this embodiment, a gap (represented by a distance between the inner surface of the developing chamber 15 and the lower end of the supplying roller 20) between the inner surface (bottom) of the developing chamber 15 formed by the partitioning member 30 and the surface of the supplying roller is set at 1.5 mm. This gap may desirably be 5.0 mm or less in order to sufficiently feed the toner positioned below the supplying roller 20 by the rotation of the supplying roller 20.

In this embodiment, a single drive inputting means for inputting the driving force to the developing unit 4 is used. The developing roller 17, the supplying roller 20, the feeding member 22 and the auxiliary supplying member 23 are connected with gears (not shown), and are rotationally driven in synchronism with each other during image formation and the like. As a result, during the rotational drive of the supplying roller 20, the feeding member 22 supplies the toner and thus it is possible to promote circulation of the toner between the developing chamber 15 and the accommodating chamber 18. Further, during the rotational drive of the supplying roller 20, the auxiliary supplying member 23 rotates, so that the feeding of the toner by the supplying roller 20 can be assisted and promoted.

Thus, in this embodiment, the toner fed by the feeding member 22 can be efficiently supplied to the nip N between the supplying roller 20 and the developing roller 17 by rotation of the supplying roller 20 and the auxiliary supplying member 23. Further, the toner (principally the toner dropping from the developing roller 17 regulated by the developing blade 21) existing in the region (space) positioned below the developing roller 17 and the supplying roller 20 in the developing chamber 15 is returned into the accommodating chamber 18 through the opening 30*a*.

3. Evaluation Experiment

In order to confirm an effect of this embodiment, the following experiment was conducted for Embodiment 4 having a constitution according to the First Embodiment and for Comparison Example 4 having the following constitution.

Comparison Example 4

Figure 12:
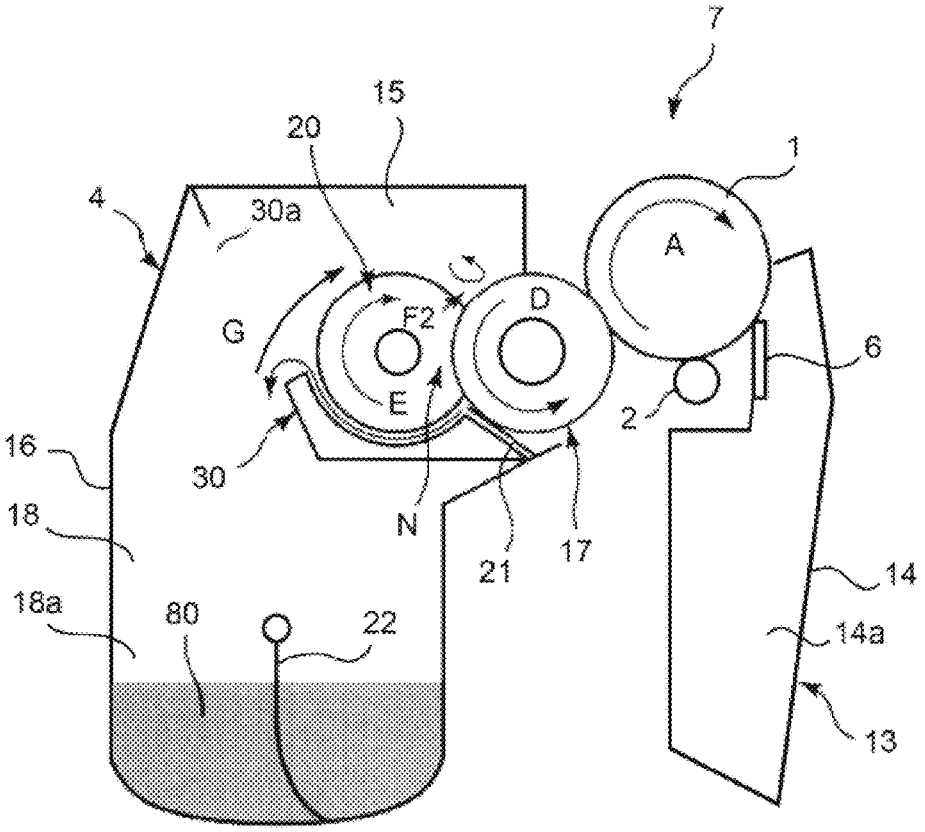
Fig. 12 (Prior Art)
FIG. 12 is a schematic sectional view of a process cartridge in Comparison Example 4.

In Comparison Example 4, the auxiliary supplying member 23 is not provided in the developing unit 4 as shown in FIG. 12 (JP-A 2015-92279). Constitutions and operations of the developing unit 4, a process cartridge 7 and an image forming apparatus 100 in Comparison Example 4 are the same as those in Embodiment 4 except that the auxiliary supplying member 23 is not provided. In Comparison Example 4, elements having the same or corresponding functions and constitutions as those in Embodiment 4 are represented by the same reference numerals or symbols.

<Contents of Experiment>

(1) Evaluation of Density Stability of Solid Image

As evaluation of density stability of a solid image, an image density lowering amount when a printing (solid image) was continuously effected was measured. The evaluation was made after the image forming apparatus 100 was left standing for 30 days in an environment of a high-temperature and high-humidity condition (temperature: 40° C., humidity: 95% RH) and then was adapted in an environment of a low-temperature and low-humidity condition (temperature: 15° C., humidity: 10% RH), and thereafter a solid image was continuously outputted on 3 sheets. Specifically, a density difference between a leading end portion and a trailing end portion of the solid image on the third sheet with respect to a recording material feeding direction was measured using a spectrodensitometer 500 (manufactured by X-Rite Inc.), and then was ranked A, B and C described below. An evaluation image was single color (black) image.

A: In a solid image, a density difference between the leading and trailing end portions was less than 0.2.

B: In the solid image, the density difference was 0.2 or more and less than 0.3.

C: In the solid image, the density difference was 0.3 or more.

<Result of Experiment>

Evaluation results of Example 4 and Comparison Example 4 are shown in Table 2.

TABLE 2

| | Evaluation item (1) SIDE*1 |
|---|---|
| COMP. EX. 4 | C |
| EMB. 4 | A |

*1"SIDS" is solid image density stability.

The results of Comparison Example 4 will be described. In Comparison Example 4, the supplying roller 20 rotates in an arrow E direction (clockwise direction), and therefore the toner supplied onto the supplying roller 20 is deposited in the retaining portion 15*a* positioned above the nip N between the supplying roller 20 and the developing roller 17, so that a toner accumulating portion is formed. However, the toner left standing for 30 days in the high-temperature and high-humidity environment is liable to agglomerate, and therefore when the toner is fed to the nip N, the toner is blocked by force of the toner blowing from the supplying roller 20 as shown in an arrow F2 in FIG. 12, so that an amount thereof supplied to the developing roller 17 becomes insufficient. For that reason, it would be considered that the density stability of the solid image was ranked C.

The result of Embodiment 4 will be described. In Embodiment 4, in addition to the constitution of Comparison Example 4, above the nip N between the supplying roller 20 and the developing roller 17, the auxiliary supplying member 23 rotating in the arrow H direction (counterclockwise direction) is disposed near the supplying roller 20 and the developing roller 17. That is, the auxiliary supplying member 23 for assisting and promoting the toner feeding by the feeding member 22 is disposed in an upstream side with respect to the toner feeding direction to the nip N by the supplying roller 20. By this auxiliary supplying member 23, a strong toner supplying force to the nip N is created. For that reason, even when the toner is liable to agglomerate as described above, the toner deposited in the retaining portion 15*a* positioned above the nip N can be fed into the nip N without being blocked by the force of the toner blowing from the supplying roller 20. By this action, the developing roller 17 can stably supply the toner, and therefore the density stability of the solid image was ranked A.

Thus, in Embodiment 4, even in the case where the toner agglomerated immediately after the standing, the toner fed by the feeding member 22 can be efficiently supplied to the nip N between the supplying roller 20 and the developing roller 17 by rotation of the supplying roller 20 and the auxiliary supplying member 23.

The structure and the rotational direction of the auxiliary supplying member 23 are not limited to those in this embodiment, but it is only required that toner feeding power to the nip N can be enhanced. For example, it is also possible to use a feeding member or the like in which a sheet-shape plate is applied onto a core metal (core material). That is, the auxiliary supplying member 23 may also be one including a rotation shaft and a sheet mounted on and rotatable about the rotation shaft.

According to this embodiment, in a constitution in which the developer accommodating portion is disposed below the supplying member and the supplying member moves downward at the nip with the developer carrying member, a lowering in developer feeding power to the developer carrying member due to the agglomeration of the developer can be suppressed. Accordingly, even in a situation, such as long-term standing in the high-temperature and high-humidity environment, that the toner is liable to agglomerate, the solid image density can be stabilized and a high-quality image can be supplied.

Fifth Embodiment (Embodiment 5)

The Fifth Embodiment of the present invention will be described. Basic constitutions and operations of a developing device, a process cartridge and an image forming apparatus are the same as those in the First Embodiment. Accordingly, in this embodiment, elements having the same or corresponding functions and constitutions which are the same as those in the First Embodiment are represented by the same reference numerals or symbols and will be omitted from detailed description.

1. Constitution of this Embodiment

Figure 13:
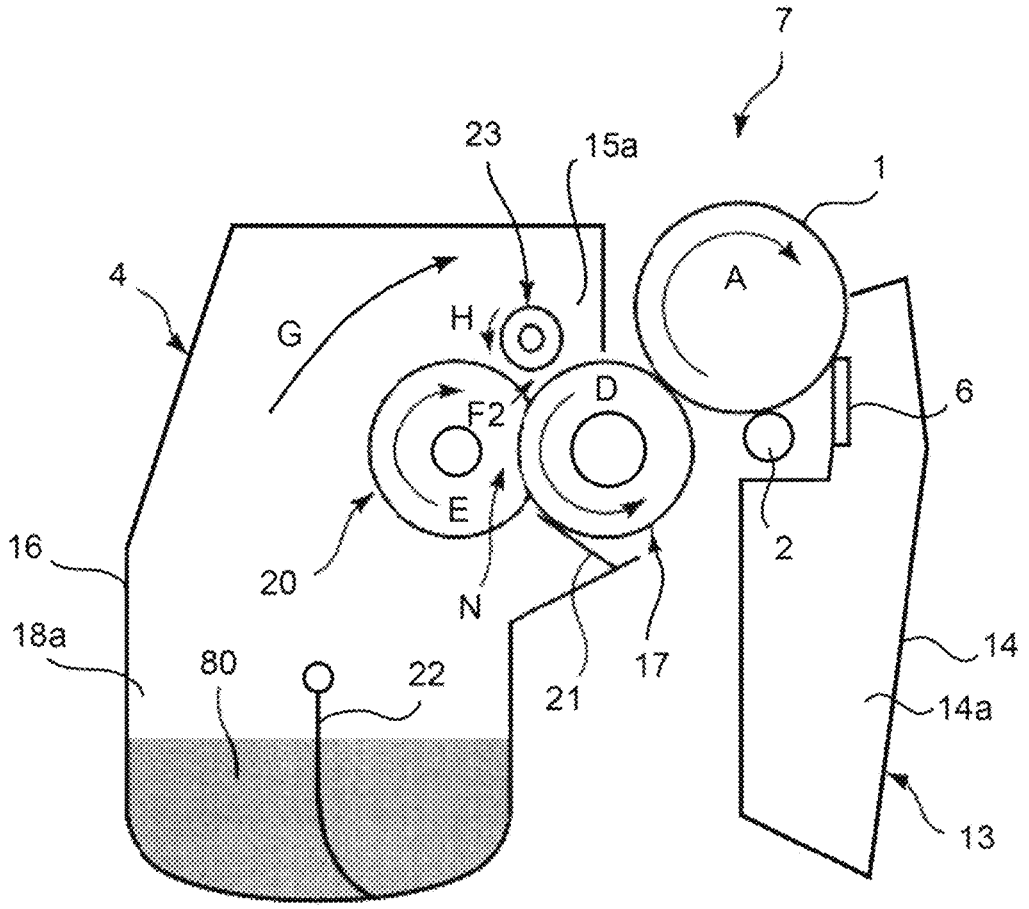
FIG. 13 is a schematic sectional view of a process cartridge in a Fifth Embodiment (Embodiment 5-1).

FIG. 13 is a schematic sectional view (principal sectional view) showing an example (Embodiment 5-1 described later) of a process cartridge 7 in this embodiment as seen along a longitudinal direction (rotational axis direction) of a photosensitive drum 1.

In this embodiment, the lowering in toner supplying power to the developing roller 17 by the supplying roller 20 is intended to be further suppressed by suppressing deterioration of the toner at a final stage of a lifetime of the developing device 4 (or the process cartridge 7) having a relatively long lifetime and by suppressing the toner agglomeration.

That is, in the case where the developer is supplied to the developer carrying member or the like against gravitation, in order to improve a toner circulating property between the neighborhood of the developer carrying member and a toner accommodating portion, a constitution in which the partitioning member for partitioning between the developing chamber and the accommodating chamber is not provided may desirably be employed. Particularly, it is desirable that the partitioning member for partitioning between the developing chamber and the accommodating chamber at a position below the supplying member, i.e., below the nip between the supplying member and the developer carrying member, is not provided. In other words, it is desirable that a member for preventing movement of the developer, which is not carried by the developer carrying member and which drops from the developer carrying member, to the accommodating portion is not provided.

Therefore, in this embodiment, a constitution in which the partitioning member 30 for partitioning between the developing chamber 15 and the accommodating chamber 18 in the First Embodiment is not provided is employed. That is, in this embodiment, in the developing unit 4, a toner accommodating portion 18*a* is formed at a lower portion of a substantially single contained constituted by the developing frame 16. The toner fed from the accommodating portion 18*a* toward the supplying roller 20 and the developing roller 17 similarly as in the First Embodiment is retained in the retaining portion 15*a* similar to that in the First Embodiment. On the other hand, in the region (space) positioned below the supplying roller 20 and the developing roller 17, the toner which is regulated by the developing blade 21 and which drops from the developing roller 17 is returned to the accommodating portion 18*a* without being blocked by the partitioning member.

2. Evaluation Experiment

In order to confirm an effect of this embodiment, the following the experiments were conducted for Embodiment 5-1 and Embodiment 5-2 having the following constitutions.

Embodiment 5-1

Embodiment 5-1 has the same constitution as the Fourth Embodiment (Embodiment 4) except that the partitioning member 30 is not provided as shown in FIG. 13.

Embodiment 5-2

Figure 14:
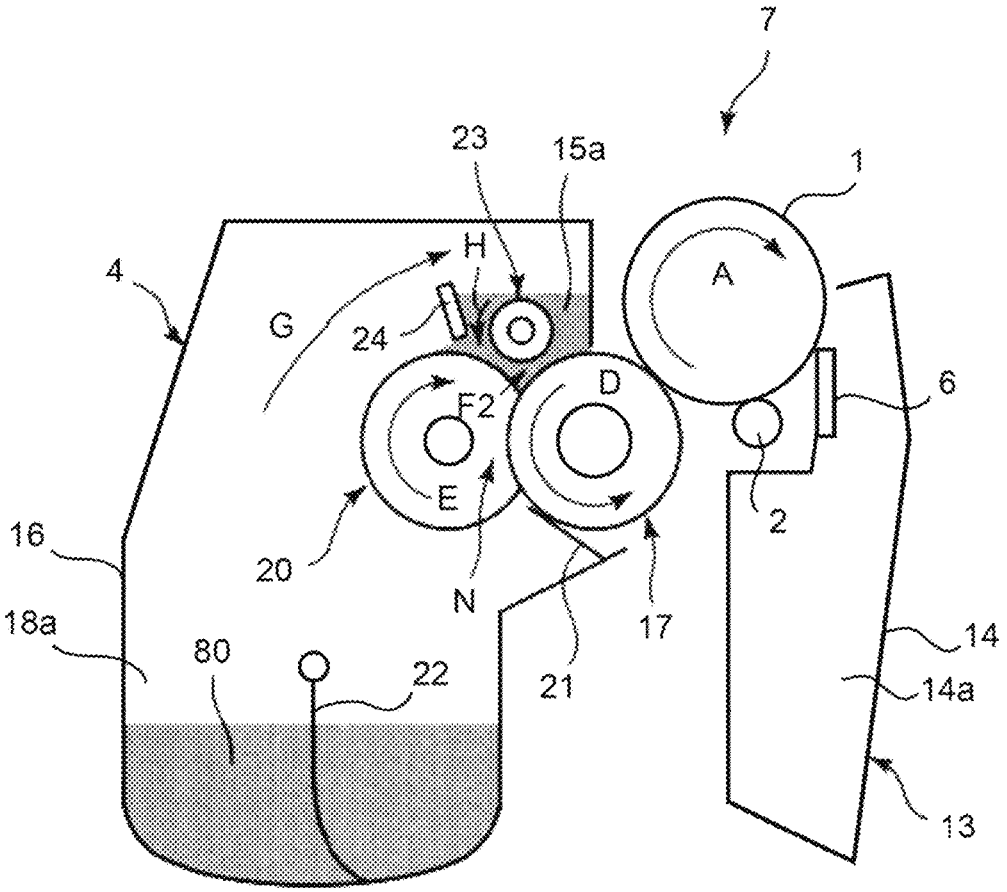
FIG. 14 is a schematic sectional view of a process cartridge in the Fifth Embodiment (Embodiment 5-2).

In Embodiment 5-2, a retaining member 24 is provided above the nip N as shown in FIG. 14. Constitutions and operations of the developing unit 4, a process cartridge 7 and an image forming apparatus 100 in Embodiment 5-2 are the same as those in Embodiment 5-1 except that the retaining member 24 is not provided. In Embodiment 5-2, elements having the same or corresponding functions and constitutions as those in Embodiment 5-1 are represented by the same reference numerals or symbols.

The retaining member 24 can accumulate the retaining portion 15*a* positioned above the nip N in an amount larger than that in the case where the retaining member 24 is not provided. For that reason, when a high print ratio image is continuously printed, an effect of further stably supplying the toner to the developing roller 17 can be obtained. In this embodiment, as the retaining member 24, a plastic-made plate of 2 mm in width (with respect to a substantially circumferential direction of the supplying roller 20) and 5 mm in height (with respect to a substantially radial direction of the supplying roller 20) was used. The retaining member 24 was disposed above the nip N near and in non-contact with the supplying roller 20. Particularly, in this embodiment, a lower end of the retaining member 24 substantially opposes an upper end (top) of the supplying roller 20 and is disposed with a predetermined gap (distance) therebetween. The retaining member 24 may also be contacted to the supplying roller 20. In this embodiment, a length of the retaining member 24 with respect to a longitudinal direction of the retaining member 24 (parallel to the rotational axis directions of the developing roller 17 and the supplying roller 20) is equal to a full length between inner walls at longitudinal end portions of the developing frame 16. However, the longitudinal length of the retaining member 24 may also be shorter than that between the inner walls, and in this case, it is desirable that the retaining member 24 is disposed in a range including a central portion between the inner walls. An upper end of the retaining member 24 does not reach an upper inner wall of the developing frame 16, so that the toner fed by the feeding member 22 gets over the upper end of the retaining member 24 and thus can be supplied above the nip N. That is, the retaining member 24 is disposed in proximity to or in contact with the supplying roller 20 in a side upstream of the nip N with respect to the rotational direction of the supplying roller 20. Further, the retaining member 24 prevents at least a part of movement of the toner existing in the retaining portion 15*a* in a direction opposite to the rotational direction of the supplying roller 20.

<Contents of Experiment>

(1) Evaluation of Density Stability of Solid Image

An evaluation experiment of density stability of a solid image which was the same as the solid image described in the First Embodiment was conducted.

(2) Evaluation of Deterioration of Toner

In order to evaluate a degree of deterioration of the toner, a two-sheet intermittent printing durability test in which images were formed on $25\times10^3$ sheets was conducted in an environment of a low-temperature and low-humidity condition (temperature: 15° C., humidity: 10% RH). In this durability test, a horizontal line image with an image ratio of 1% was printed on paper, and 200 g of the toner was charged in the developing unit 4. Measurement of the degree of deterioration of the toner at the nip N after an end of the test was made using an automatic specific surface area measuring device (manufactured by Micromeritics Japan). From a result of measured values of the degree of deterioration, the following ranking was determined. An evaluation image was a single color (black) image.

A: The measured value is 2.0 or more, and no image defect such as stripe image and density non-uniformity generates.

B: The measured value is 1.8 or more and less than 2.0, and no image defect generates.

C: The measured value is less than 1.8, and the image defect generates.

<Result of Experiment>

Evaluation results of Example 5-1 and Embodiment 5-2 are shown in Table 3.

TABLE 3

| | Evaluation item | |
|---|---|---|
| | (1) SIDE*1 | (2) TD*2 |
| EMB. 5-1 | A | A |
| EMB. 5-2 | A | A |

*1"SIDS" is solid image density stability.
*2"TD" is toner deterioration.

The results of Embodiment 5-1 will be described. In Embodiment 5-1, similarly as in First Embodiment (Embodiment 1), a strong toner supplying force is generated by the auxiliary supplying member 23, and therefore even in a situation such that the toner agglomeration is liable to generate, the toner can be satisfactorily supplied into the nip N. By this action, the developing roller 17 can stably supply the toner, and therefore the density stability of the solid image was ranked A.

Further, there is no partitioning member between the developing chamber 15 and the accommodating chamber 18, so that a degree of stagnation of the toner which can generate in the developing chamber 15 or the like in a harsh situation as in the above-described evaluation experiment decreases, and therefore the degree of deterioration of the toner at the time of $25\times10^3$ sheets was ranked A. Thus, in Embodiment 5-1, a toner circulating property is improved, so that the toner deterioration can be suppressed.

The result of Embodiment 5-2 will be described. Also in Embodiment 5-2, the density stability of the solid image was ranked A similarly as in Embodiment 5-1. However, when the evaluation test was repetitively conducted, in Embodiment 5-2, the density stability was higher than that in Embodiment 5-1. That is, in Embodiment 5-2, the retaining member 24 is provided above the nip N between the supplying roller 20 and the developing roller 17, so that it is possible to retain the toner in an amount larger than in Embodiment 5-1 in which the retaining member 24 is not provided. For that reason, also when continuous printing in which has toner consumption amount is large and the solid image with a high print ratio is continuously formed is made, an effect of further stably supplying the toner to the developing roller 17 can be obtained. Further, also in the constitution of Embodiment 5-2, the strong toner supplying force was generated by the auxiliary supplying member 23, and therefore it was possible to satisfactorily supply, into the nip N, the toner deposited in a relatively large amount at the retaining portion 15*a* positioned above the nip N.

Further, similarly as in Embodiment 5-1, no partitioning member is provided between the developing chamber 15 and the accommodating chamber 18, so that the toner deterioration can be suppressed, and thus the degree of the toner deterioration was ranked A.

Thus, in Embodiments 5-1 and 5-2, by disposing no partitioning member between the developing chamber 15 and the accommodating chamber 18, the toner circulating property is improved so that it is possible to suppress the toner deterioration at a later stage of the lifetime of the developing unit 4 (or the process cartridge 7) having a relatively long lifetime. Further, similarly as in First Embodiment (Embodiment 1), even in the case where the toner agglomerates immediately after the standing, it is possible to efficiently supply the toner to the nip N between the supplying roller 20 and the developing roller 17 by rotation of the supplying roller 20 and the auxiliary supplying member 23. That is, in Embodiments 5-1 and 5-2, it becomes possible to not only stabilize the density of the solid image but also suppress the deterioration of the toner.

A material and a shape of the retaining member 24 are not limited to those in Embodiment 5-2, but may only be required that the resultant retaining member 24 can accumulate the toner at the retaining portion 15*a* positioned above the nip N.

Other Embodiments

The present invention was described above based on the embodiments, but is not limited thereto.

In the above-described embodiments, the image forming apparatus capable of forming the color image was described as an example, but even an image forming apparatus capable of forming a monochromatic image can obtain a similar effect.

Further, in the above-described embodiments, as the image forming apparatus, the printer was described as an example, but the present invention is not limited thereto. For example, even other image forming apparatuses such as a copying machine, a facsimile machine and a multi-function machine having a combination of functions of these machine can obtain a similar effect. Further, even an image forming apparatus in which a recording material carrying member is used and respective color toner images are successively transferred superposedly from the recording material carrying member onto a recording material can obtain a similar effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-214982 filed on Oct. 30, 2015, and 2015-214954 filed on Oct. 30, 2015, which are hereby incorporated by reference herein in their entirety.

What is claimed is:

1. A developing device for use with an image forming apparatus, comprising:

a developer carrying member being rotatable and configured to carry a developer for developing a latent image;

a supplying member, for supplying the developer to said developer carrying member, configured to be rotatable and to form a nip in contact with said developer carrying member;

an accommodating portion, provided below said supplying member in a state the developing device is mounted on the image forming apparatus for use, for accommodating the developer to be supplied from said supplying member to said developer carrying member;

a feeding member, provided in said accommodating portion, for feeding the developer accommodated in said accommodating portion to said supplying member;

a rotatable member, provided above said feeding member and located at a downstream side of the nip with respect to a rotational direction of said supplying member, for moving the developer toward the nip; and a retaining portion for retaining the developer supplied to said supplying member, wherein said supplying member rotates so that a surface thereof moves downward at the nip, and wherein said rotatable member opposes said supplying member and is disposed in said retaining portion provided below the nip.

2. The developing device according to claim 1, wherein said supplying member and said developer carrying member rotate so that surfaces thereof move in the same direction at the nip.

3. The developing device according to claim 1, further comprising:

a developing chamber including said developer carrying member, said supplying member and said rotatable member, wherein said retaining portion is formed inside of said developing chamber;

an accommodating chamber provided below said developing chamber, wherein said accommodating portion is formed inside of said accommodating chamber; and a partitioning member, provided with an opening, for establishing communication between said developing chamber and said accommodating chamber and through which the developer fed by said feeding member passes.

4. The developing device according to claim 1, wherein said supplying member includes a foam member at a surface thereof.

5. The developing device according to claim 1, wherein said rotatable member includes a rotation shaft and a sheet mounted on said rotation shaft and rotatable about said rotation shaft.

6. The developing device according to claim 1, wherein said rotatable member includes a foam member at a surface thereof.

7. The developing device according to claim 1, wherein said supplying member and said rotatable member are rotatable so as to move in opposite directions to each other at an opposing portion thereof.

8. A process cartridge detachably mountable to a main assembly of the image forming apparatus, comprising:

an image bearing member on which the latent image is to be formed; and the developing device according to claim 1.

9. An image forming apparatus for forming an image on a recording material, comprising:

an image bearing member on which the latent image is to be formed; and the developing device according to claim 1.

10. The image forming apparatus according to claim 9, further comprising an intermediary transfer member provided above said image bearing member and onto which a developer image formed on said developer carrying member is to be transferred.

11. The image forming apparatus according to claim 9, further comprising an exposure device, provided below said image bearing member, for exposing said image bearing member to light to form the latent image.

* * * * *